US009671074B2

(12) United States Patent
Chen

(10) Patent No.: US 9,671,074 B2
(45) **Date of Patent: *Jun. 6, 2017**

(54) MODULAR TREE WITH TRUNK CONNECTORS

(71) Applicant: Willis Electric Co., Ltd., Taipei (TW)

(72) Inventor: Johnny Chen, Taipei (TW)

(73) Assignee: Willis Electric Co., Ltd., Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/209,276

(22) Filed: Mar. 13, 2014

(65) Prior Publication Data

US 2014/0268689 A1 Sep. 18, 2014

Related U.S. Application Data

(60) Provisional application No. 61/780,381, filed on Mar. 13, 2013.

(51) Int. Cl.

| | |
|---|---|
| ***F21S 6/00*** | (2006.01) |
| ***F21S 4/00*** | (2016.01) |
| ***A47G 33/06*** | (2006.01) |
| ***F21S 4/10*** | (2016.01) |
| *F21W 121/00* | (2006.01) |

(52) U.S. Cl.

CPC ..... *F21S 4/001* (2013.01); *A47G 33/06* (2013.01); *F21S 4/10* (2016.01); *F21W 2121/00* (2013.01); *Y10T 29/49208* (2015.01)

(58) Field of Classification Search

CPC F21V 19/0085; A47G 33/06; H04N 13/0203; A61B 5/115; F21S 4/001

USPC ..... 362/123

See application file for complete search history.

(56) References Cited

U.S. PATENT DOCUMENTS

| | | | |
|---|---|---|---|
| 438,310 | A | 10/1890 | Edison |
| 735,010 | A | 7/1903 | Zahl |
| 860,406 | A | 7/1907 | McGahan |
| 1,314,008 | A | 8/1919 | McWilliams |
| 1,372,777 | A | 3/1921 | Samuel et al. |
| 1,495,695 | A | 5/1924 | Karr |
| 1,536,332 | A | 5/1925 | Dam |
| 1,590,220 | A | 6/1926 | Wurts |
| 1,656,148 | A | 1/1928 | Harris |
| 1,677,972 | A | 7/1928 | Marks |
| 1,895,656 | A | 1/1933 | Gadke |

(Continued)

FOREIGN PATENT DOCUMENTS

| | | |
|---|---|---|
| CA | 1182513 | 2/1985 |
| CN | 1182513 | 2/1985 |

(Continued)

*Primary Examiner* — Anh Mai
*Assistant Examiner* — Matthew Peerce
(74) *Attorney, Agent, or Firm* — Christensen, Fonder, Dardi & Herbert PLLC

(57) ABSTRACT

A lighted artificial tree as that includes a first trunk body, a second trunk body, a first electrical connector, and a second electrical connector. The first electrical connector is housed in the first trunk body, and the second electrical connector is housed in the second trunk body. The first trunk body is configured to couple to the second trunk body, causing the first and second electrical connectors to make electrical connection, the first electrical connector being rotationally locked to the second electrical connector.

22 Claims, 34 Drawing Sheets

(56) References Cited

U.S. PATENT DOCUMENTS 1,974,472 A 9/1934 Seghers
2,025,189 A 12/1935 Yanchenko
2,050,364 A 8/1936 Morton
2,072,337 A 3/1937 Kamm
2,112,281 A 3/1938 Ferris
2,186,351 A 1/1940 Stojaneck
2,188,529 A 1/1940 Corina
2,229,211 A 1/1941 Korengold
2,466,499 A 4/1949 Sokolik
2,484,596 A 10/1949 Waltz
2,533,374 A 12/1950 Hyland
2,563,713 A 8/1951 Frei et al.
2,570,751 A 10/1951 Benander
2,636,069 A 4/1953 Gilbert
2,782,296 A 2/1957 Walter
2,806,938 A 9/1957 Henry
2,857,506 A 10/1958 Minteer
2,863,037 A 12/1958 Johnstone
2,910,842 A 11/1959 Sensenig
2,932,811 A 4/1960 Abraham et al.
2,969,456 A 1/1961 Raymaley
2,973,546 A 3/1961 Roche
2,984,813 A 5/1961 Bossi
3,107,966 A 10/1963 Bonhomme
3,115,435 A 12/1963 Abramson
3,118,617 A 1/1964 Hellrich
3,120,351 A 2/1964 Kirsten
3,214,579 A 10/1965 Pacini
3,233,207 A 2/1966 Ahroni et al.
3,286,088 A 11/1966 Ahroni
3,296,430 A 1/1967 Eckert
3,345,482 A 10/1967 Lou
3,398,260 A 8/1968 Martens
3,409,867 A 11/1968 Lessner
3,470,527 A 9/1969 Bonhomme
3,504,169 A 3/1970 Freeburger
3,521,216 A 7/1970 Tolegian
3,522,579 A 8/1970 Matsuya
3,571,586 A 3/1971 Duckworth
3,574,102 A 4/1971 Hermanson
3,585,564 A 6/1971 Skjervoll
3,594,260 A 7/1971 Dieffenbach
3,603,780 A 9/1971 Lu
3,616,107 A 10/1971 Kershner
3,617,732 A 11/1971 Fisher
3,640,496 A 2/1972 Duncan
3,663,924 A 5/1972 Gerlat
3,704,366 A 11/1972 Korb et al.
3,715,708 A 2/1973 Lloyd et al.
3,728,787 A 4/1973 McDonough
3,748,488 A 7/1973 Davis, Jr.
3,764,862 A 10/1973 Jankowski
3,783,437 A 1/1974 Graff et al.
3,806,399 A 4/1974 Cocjin
3,808,450 A 4/1974 Davis, Jr.
3,812,380 A 5/1974 Davis, Jr.
3,819,459 A 6/1974 Wren
3,862,434 A 1/1975 Davis, Jr.
3,864,580 A 2/1975 Davis, Jr.
3,914,786 A 10/1975 Grossi
3,970,834 A * 7/1976 Smith ..... 362/123
3,971,619 A 7/1976 Rohrssen
3,985,924 A 10/1976 Pritza
4,012,631 A 3/1977 Creager
4,020,201 A 4/1977 Miller
4,045,868 A 9/1977 Ammon et al.
4,057,735 A 11/1977 Davis, Jr.
4,072,857 A 2/1978 DeVicaris
4,097,917 A 6/1978 McCaslin
4,109,345 A 8/1978 Sargent et al.
4,125,781 A 11/1978 Davis, Jr.
4,140,823 A 2/1979 Weskamp
4,153,860 A 5/1979 Vonick
4,161,768 A 7/1979 Gauthier et al.
4,215,277 A 7/1980 Weiner et al.
4,245,875 A 1/1981 Shaffer et al.
4,248,916 A 2/1981 Chase
4,273,814 A 6/1981 Koehler
4,291,075 A 9/1981 Puleo
4,340,841 A 7/1982 Schupp
4,343,842 A 8/1982 Chase
4,437,782 A 3/1984 Geisthoff
4,447,279 A 5/1984 Boisvert et al.
4,451,510 A 5/1984 Boisvert et al.
4,462,065 A 7/1984 Rhodes
4,493,523 A 1/1985 Leong et al.
4,496,615 A 1/1985 Huang
4,516,193 A 5/1985 Murphy
4,519,666 A 5/1985 Williams et al.
4,546,041 A 10/1985 Keane et al.
4,573,102 A 2/1986 Norwood
4,620,270 A 10/1986 Laakso
4,631,650 A 12/1986 Ahroni
4,659,597 A 4/1987 Lau
4,675,575 A 6/1987 Smith et al.
4,678,926 A 7/1987 Davis
4,712,299 A 12/1987 Loewen et al.
4,720,272 A 1/1988 Durand
4,727,449 A 2/1988 Fleck
4,753,600 A 6/1988 Williams
4,759,729 A 7/1988 Kemppainen et al.
4,769,579 A 9/1988 Jou
4,772,215 A 9/1988 Falk
4,775,922 A 10/1988 Engel
4,777,573 A 10/1988 Liao
4,779,177 A 10/1988 Ahroni
4,789,570 A 12/1988 Maddock
4,799,902 A 1/1989 Laudig et al.
4,805,075 A 2/1989 Damore
4,807,098 A 2/1989 Ahroni
4,808,885 A 2/1989 Bauch et al.
4,855,880 A 8/1989 Mancusi Jr.
4,859,205 A 8/1989 Fritz
4,867,690 A 9/1989 Thumma
4,870,547 A 9/1989 Crucefix
4,870,753 A 10/1989 Pfeffer et al.
4,890,000 A 12/1989 Chou
4,894,019 A 1/1990 Howard
4,899,266 A 2/1990 Ahroni
4,908,743 A 3/1990 Miller
4,921,426 A 5/1990 Kawasaki et al.
4,934,964 A 6/1990 Mazelle
5,015,510 A 5/1991 Smith
5,033,976 A 7/1991 Sarian et al.
5,051,877 A 9/1991 Liao
5,071,362 A 12/1991 Martens et al.
5,073,132 A 12/1991 Nottrott
5,088,669 A 2/1992 Zinnbauer
5,091,834 A 2/1992 Kao et al.
5,104,608 A 4/1992 Pickering
5,109,324 A 4/1992 Ahroni
5,121,310 A 6/1992 Ahroni
5,128,595 A 7/1992 Hara
5,139,343 A 8/1992 Lin
5,149,282 A * 9/1992 Donato ..... F21V 15/04
248/160
5,154,508 A 10/1992 Ahroni
5,213,407 A 5/1993 Eisenbraun
5,217,382 A 6/1993 Sparks
5,218,233 A 6/1993 Takahashi
5,281,158 A 1/1994 Lin
5,300,864 A 4/1994 Allen, Jr.
5,334,025 A 8/1994 Föhl
5,342,661 A 8/1994 Wilcox, II
5,349,780 A 9/1994 Dyke
5,350,315 A 9/1994 Cheng et al.
5,366,386 A 11/1994 Liao
5,380,215 A 1/1995 Huang
5,389,008 A 2/1995 Cheng et al.
5,390,463 A 2/1995 Sollner
D356,246 S 3/1995 Adams
5,409,403 A 4/1995 Falossi et al.
5,422,766 A 6/1995 Hack et al.
5,442,258 A 8/1995 Shibata

(56) References Cited

U.S. PATENT DOCUMENTS 5,453,664 A 9/1995 Harris
5,455,750 A 10/1995 Davis et al.
5,456,620 A 10/1995 Kaminski
5,481,444 A 1/1996 Schultz
D367,257 S 2/1996 Buelow et al.
5,517,390 A 5/1996 Zins
5,518,425 A 5/1996 Tsai
5,536,538 A 7/1996 Hartung
5,541,818 A 7/1996 Ng et al.
5,550,720 A 8/1996 Carroll
5,559,681 A 9/1996 Duarte
5,560,975 A 10/1996 Casper
D375,483 S 11/1996 Tashiro
5,580,159 A 12/1996 Liu
5,586,905 A 12/1996 Marshall et al.
5,605,395 A 2/1997 Peng
5,607,328 A 3/1997 Joly
5,624,283 A 4/1997 Hotea
5,626,419 A 5/1997 Lin
5,629,587 A 5/1997 Gray et al.
5,639,157 A 6/1997 Yeh
5,652,032 A 7/1997 Kaczor et al.
5,653,616 A 8/1997 Hotea
5,695,279 A 12/1997 Sonnleitner et al.
5,702,262 A 12/1997 Brown et al.
5,702,268 A 12/1997 Lien et al.
5,707,136 A 1/1998 Byers
5,709,457 A 1/1998 Hara
5,712,002 A 1/1998 Reilly, III
5,720,544 A 2/1998 Shu
5,722,766 A 3/1998 Shu
5,727,872 A 3/1998 Liou
5,759,062 A 6/1998 Chen
5,775,933 A 7/1998 Chen
5,776,559 A 7/1998 Woolford
5,776,599 A 7/1998 Haluska et al.
5,785,412 A 7/1998 Wu et al.
5,788,361 A 8/1998 Lee
5,791,765 A 8/1998 Lin
5,791,940 A 8/1998 Chen et al.
5,807,134 A 9/1998 Hara
5,816,849 A 10/1998 Schmidt
5,816,862 A 10/1998 Tseng
5,820,248 A 10/1998 Ferguson
5,822,855 A 10/1998 Szczesny et al.
5,828,183 A 10/1998 Wang et al.
5,829,865 A 11/1998 Ahroni
5,834,901 A 11/1998 Shen
5,839,819 A 11/1998 Pan
5,848,838 A 12/1998 Presta
5,852,348 A 12/1998 Lin
5,854,541 A 12/1998 Chou
5,855,705 A 1/1999 Gauthier
5,860,731 A 1/1999 Martinez
5,860,830 A 1/1999 Wu
5,869,151 A 2/1999 Chong
5,878,989 A 3/1999 Allman
5,893,634 A 4/1999 Wang
5,908,238 A 6/1999 Huang
5,921,806 A 7/1999 Shuey
5,934,793 A 8/1999 Rahman
5,937,496 A 8/1999 Benoit et al.
5,938,168 A 8/1999 Adams
5,957,723 A 9/1999 Gort-Barten
5,966,393 A 10/1999 Hide et al.
5,971,810 A 10/1999 Taylor
5,979,859 A 11/1999 Vartanov et al.
6,004,006 A 12/1999 Wang
6,007,362 A 12/1999 Davis et al.
6,030,670 A 2/2000 Chang
6,053,774 A 4/2000 Lin
6,056,427 A 5/2000 Kao
6,079,848 A 6/2000 Ahroni
6,084,357 A 7/2000 Janning
6,086,395 A 7/2000 Lloyd et al.
6,095,874 A 8/2000 Quaranta
6,099,920 A 8/2000 Kao
6,111,201 A 8/2000 Drane et al.
6,113,430 A 9/2000 Wu
6,116,563 A 9/2000 Tsai
6,120,312 A 9/2000 Shu
6,123,433 A 9/2000 Chen
6,139,376 A 10/2000 Ooya et al.
6,147,367 A 11/2000 Yang et al.
6,149,448 A 11/2000 Haller et al.
6,155,697 A 12/2000 Ahroni
6,162,515 A 12/2000 Hill
6,203,169 B1 3/2001 Coushaine et al.
6,217,191 B1 4/2001 Wu et al.
6,228,442 B1 5/2001 Coco
6,241,559 B1 6/2001 Taylor
6,245,425 B1 6/2001 McCullough et al.
6,257,736 B1 7/2001 Fehrenbach
6,257,740 B1 7/2001 Gibboney, Jr.
6,257,793 B1 7/2001 Lin
6,261,119 B1 7/2001 Green
6,273,584 B1 8/2001 Wang et al.
6,283,797 B1 9/2001 Wu
6,285,140 B1 9/2001 Ruxton
6,292,901 B1 9/2001 Lys et al.
6,320,327 B1 11/2001 Lavatelli et al.
6,328,593 B1 12/2001 Chang et al.
6,347,965 B1 2/2002 Pan
D454,110 S 3/2002 Andre et al.
6,354,719 B1 3/2002 Pan
6,361,368 B1 3/2002 Tseng
6,363,607 B1 4/2002 Chen et al.
6,407,411 B1 6/2002 Wojnarowski et al.
6,452,317 B1 9/2002 Tseng
6,457,839 B1 * 10/2002 Grandoit ..... 362/123
6,458,435 B1 * 10/2002 Lai ..... 428/20
6,514,581 B1 2/2003 Gregory
6,533,437 B1 3/2003 Ahroni
6,541,800 B2 4/2003 Barnett et al.
6,544,070 B1 4/2003 Radliff
6,571,340 B1 5/2003 Lee
6,576,844 B1 6/2003 Kamata
6,580,182 B2 6/2003 Janning
6,588,914 B1 7/2003 Tang
6,592,094 B1 7/2003 Kao
6,595,657 B1 7/2003 Shieh
D478,310 S 8/2003 Andre et al.
6,609,814 B2 8/2003 Ahroni
6,623,291 B1 9/2003 Tsai
6,634,766 B1 10/2003 Gordon
6,644,836 B1 11/2003 Adams
6,653,797 B2 11/2003 Puleo, Sr. et al.
D483,721 S 12/2003 Kim et al.
6,666,734 B2 12/2003 Fukatsu
6,672,750 B1 1/2004 Kao
D486,385 S 2/2004 Smith-Kielland et al.
6,733,167 B1 5/2004 Kao
6,752,512 B2 6/2004 Pan
6,774,549 B2 8/2004 Tsai et al.
6,794,825 B1 9/2004 Kao
6,805,463 B2 10/2004 Shieh
6,824,293 B2 11/2004 Chang
6,830,358 B2 12/2004 Allen
6,840,655 B2 1/2005 Shen
6,840,802 B2 1/2005 Shepherd
6,866,394 B1 3/2005 Hutchins et al.
6,869,316 B2 3/2005 Hinkle et al.
6,883,951 B2 4/2005 Wu
6,884,083 B2 4/2005 Shepherd
6,908,215 B2 6/2005 Wu
6,929,383 B1 8/2005 Janning
D509,797 S 9/2005 Milan
6,942,355 B1 9/2005 Castiglia
6,951,405 B2 10/2005 Yao
6,962,498 B2 11/2005 Kohen et al.
7,021,598 B2 4/2006 Kao
7,029,145 B2 4/2006 Frederick
7,045,965 B2 5/2006 Li et al.
7,052,156 B2 5/2006 Primeau

(56) References Cited

U.S. PATENT DOCUMENTS 7,055,980 B2 6/2006 Wu
7,055,981 B2 6/2006 Yao
7,066,628 B2 6/2006 Allen
7,066,739 B2 6/2006 McLeish
7,108,514 B2 9/2006 Chen et al.
D530,277 S 10/2006 Lin
7,132,139 B2 11/2006 Yang
7,144,610 B1 12/2006 Estes et al.
7,145,105 B2 12/2006 Gaulard
7,147,518 B2 12/2006 Marechal et al.
7,192,303 B2 3/2007 Kohen
7,204,720 B1 4/2007 Shiu
7,207,844 B2 4/2007 Peng
7,235,815 B2 6/2007 Wang
7,253,556 B1 8/2007 Gibboney
7,253,714 B1 8/2007 Tsui
7,264,392 B2 9/2007 Massabki et al.
7,270,450 B2 9/2007 Chan
7,311,566 B2 12/2007 Dent
7,315,692 B2 1/2008 Chow
7,318,744 B2 1/2008 Kuo
7,326,091 B2 2/2008 Nania et al.
7,393,019 B2 7/2008 Taga et al.
7,422,489 B1 9/2008 Tseng
D580,355 S 11/2008 Hussaini et al.
7,445,824 B2 11/2008 Leung et al.
7,453,194 B1 11/2008 Gibboney
D582,846 S 12/2008 Lett
7,462,066 B2 12/2008 Kohen
D585,384 S 1/2009 Andre et al.
7,473,024 B2 1/2009 Gibboney
7,527,508 B1 5/2009 Lee et al.
7,554,266 B1 6/2009 Chen
D598,374 S 8/2009 Sasada
7,575,362 B1 8/2009 Hsu
7,581,870 B2 9/2009 Massabki et al.
7,585,187 B2 9/2009 Daily et al.
7,585,552 B2 9/2009 Meseke
7,609,006 B2 10/2009 Gibboney
D608,685 S 1/2010 Krize
7,652,210 B2 1/2010 White
D609,602 S 2/2010 Krize
D611,409 S 3/2010 Green et al.
7,695,298 B2 4/2010 Arndt et al.
7,893,627 B2 2/2011 Li
D638,355 S 5/2011 Chen
8,007,129 B2 8/2011 Yang
8,053,042 B1 11/2011 Loomis
8,062,718 B2 11/2011 Schooley
8,100,546 B2 1/2012 Lutz et al.
8,132,360 B2 3/2012 Jin et al.
8,132,649 B2 3/2012 Rogers
8,298,633 B1 10/2012 Chen
8,348,466 B2 1/2013 Plumb et al.
8,450,950 B2 5/2013 McRae
8,454,186 B2 6/2013 Chen
8,454,187 B2 6/2013 Chen
8,469,734 B2 6/2013 Chen
8,469,750 B2 6/2013 Chen
D686,523 S 7/2013 Chen
8,534,186 B2 9/2013 Glucksman et al.
8,562,175 B2 10/2013 Chen
8,568,015 B2 10/2013 Chen
8,569,960 B2 10/2013 Chen
8,573,548 B2 11/2013 Kuhn et al.
8,592,845 B2 11/2013 Chen
D696,153 S 12/2013 Chen
8,608,342 B2 12/2013 Chen
8,853,721 B2 10/2014 Chen
8,863,416 B2 10/2014 Leung et al.
8,870,404 B1 10/2014 Chen
8,876,321 B2 11/2014 Chen
8,936,379 B1 1/2015 Chen
8,959,810 B1 2/2015 Leung et al.
8,974,072 B2 3/2015 Chen
9,044,056 B2 6/2015 Chen
9,055,777 B2 6/2015 Chen
9,066,617 B2 6/2015 Chen
9,119,495 B2 9/2015 Leung et al.
9,157,587 B2 10/2015 Chen
9,179,793 B2 11/2015 Chen
9,220,361 B1 12/2015 Chen
9,222,656 B2 12/2015 Chen
9,439,528 B2 9/2016 Chen
9,441,800 B1 9/2016 Chen
9,441,823 B1 9/2016 Chen
9,484,687 B1 11/2016 Chen
2002/0002015 A1 1/2002 Mochizuki et al.
2002/0097573 A1* 7/2002 Shen ..... 362/123
2002/0109989 A1 8/2002 Chuang
2002/0118540 A1 8/2002 Ingrassia
2002/0149936 A1 10/2002 Mueller et al.
2003/0096542 A1 5/2003 Kojima
2003/0142494 A1 7/2003 Ahroni
2003/0198044 A1 10/2003 Lee
2003/0198048 A1 10/2003 Frederick
2003/0206412 A1 11/2003 Gordon
2003/0218412 A1 11/2003 Shieh
2004/0004435 A1 1/2004 Hsu
2004/0012950 A1 1/2004 Pan
2004/0090770 A1* 5/2004 Primeau ..... F21S 4/10 362/123
2004/0096596 A1 5/2004 Palmer, III et al.
2004/0105270 A1 6/2004 Shieh
2004/0115984 A1 6/2004 Rudy et al.
2004/0145916 A1 7/2004 Wu
2004/0161552 A1 8/2004 Butts, Jr.
2004/0182597 A1 9/2004 Smith et al.
2005/0048226 A1 3/2005 Gary et al.
2005/0077525 A1 4/2005 Lynch et al.
2005/0122723 A1 6/2005 Frederick
2005/0249892 A1 11/2005 Rocheleau
2005/0286267 A1 12/2005 Wang
2006/0000634 A1 1/2006 Arakawa
2006/0048397 A1 3/2006 King et al.
2006/0146578 A1 7/2006 Kuo
2006/0164834 A1 7/2006 Kao
2006/0270250 A1 11/2006 Allen
2006/0274556 A1 12/2006 Massabki et al.
2007/0091606 A1 4/2007 Reed
2007/0092664 A1 4/2007 Chun
2007/0177402 A1 8/2007 Wu
2007/0230174 A1 10/2007 Hicks et al.
2007/0253191 A1 11/2007 Chin et al.
2007/0273296 A9 11/2007 Janning
2008/0007951 A1 1/2008 Chan
2008/0025024 A1 1/2008 Yu
2008/0107840 A1 5/2008 Leung et al.
2008/0149791 A1 6/2008 Bradley
2008/0186731 A1 8/2008 Graham
2008/0186740 A1 8/2008 Huang et al.
2008/0205020 A1 8/2008 Vich
2008/0283717 A1 11/2008 Kim et al.
2008/0296604 A1 12/2008 Chou et al.
2008/0303446 A1 12/2008 Ding
2008/0307646 A1 12/2008 Zaderej et al.
2009/0002991 A1 1/2009 Huang
2009/0023315 A1 1/2009 Pfeiffer
2009/0059578 A1 3/2009 Lau
2009/0213620 A1 8/2009 Lee
2009/0260852 A1 10/2009 Schaffer
2009/0289560 A1 11/2009 Oliva
2010/0000065 A1 1/2010 Cheng et al.
2010/0053991 A1 3/2010 Boggs
2010/0067242 A1 3/2010 Fung
2010/0072747 A1 3/2010 Krize
2010/0099287 A1 4/2010 Colburn et al.
2010/0136808 A1 6/2010 Vanzo
2010/0159713 A1 6/2010 Nishihira et al.
2010/0195332 A1 8/2010 Wasem
2010/0196628 A1 8/2010 Shooley
2010/0263911 A1 10/2010 Watanabe
2011/0062875 A1 3/2011 Altamura
2011/0076425 A1 3/2011 Cheng et al.

(56) References Cited

U.S. PATENT DOCUMENTS

| | | | | |
|---|---|---|---|---|
| 2011/0256750 | A1 | 10/2011 | Chen | |
| 2012/0009360 | A1* | 1/2012 | Fu et al. | 428/8 |
| 2012/0236546 | A1* | 9/2012 | Chen | 362/123 |
| 2013/0093334 | A1 | 4/2013 | Lin et al. | |
| 2013/0108808 | A1 | 5/2013 | Leung et al. | |
| 2013/0120971 | A1 | 5/2013 | Chen | |
| 2013/0301245 | A1 | 11/2013 | Chen | |
| 2013/0301247 | A1 | 11/2013 | Chen | |
| 2013/0308301 | A1 | 11/2013 | Chen | |
| 2013/0309908 | A1 | 11/2013 | Sandoval et al. | |
| 2014/0049948 | A1 | 2/2014 | Chen | |
| 2014/0087094 | A1 | 3/2014 | Leung et al. | |
| 2014/0215864 | A1 | 8/2014 | Fischer, Jr. et al. | |
| 2014/0287618 | A1 | 9/2014 | Chen | |
| 2014/0334134 | A1* | 11/2014 | Loomis | 362/123 |
| 2015/0029703 | A1 | 1/2015 | Chen | |
| 2015/0070878 | A1* | 3/2015 | Yu | 362/123 |
| 2015/0157159 | A1 | 6/2015 | Leung et al. | |
| 2015/0272250 | A1 | 10/2015 | Chen | |
| 2016/0007430 | A1 | 1/2016 | Kidakarn | |
| 2016/0021957 | A1 | 1/2016 | Chen | |
| 2016/0021958 | A1 | 1/2016 | Chen | |
| 2016/0033097 | A1 | 2/2016 | Chen | |

FOREIGN PATENT DOCUMENTS

| | | | |
|---|---|---|---|
| CN | 2102058 | U | 4/1992 |
| CN | 2242654 | Y | 12/1996 |
| CN | 1181693 | | 5/1998 |
| CN | 2332290 | Y | 8/1999 |
| CN | 2484010 | Y | 4/2002 |
| CN | 1509670 | A | 7/2004 |
| CN | 2631782 | Y | 8/2004 |
| CN | 2751226 | Y | 1/2006 |
| CN | 100409504 | C | 9/2007 |
| CN | 100409506 | C | 8/2008 |
| CN | 201187701 | Y | 1/2009 |
| CN | 201829727 | U | 5/2011 |
| CN | 102224645 | A | 10/2011 |
| DE | 8436328 | | 4/1985 |
| DE | 10235081 | A1 | 2/2004 |
| EP | 434425 | A1 | 6/1991 |
| EP | 0552741 | | 7/1993 |
| EP | 0342050 | B1 | 8/1995 |
| EP | 0727842 | | 8/1996 |
| EP | 895742 | B1 | 2/1999 |
| EP | 0920826 | | 6/1999 |
| EP | 1 049 206 | | 11/2000 |
| EP | 1763115 | A2 | 3/2007 |
| EP | 2533374 | A1 | 12/2012 |
| FR | 1215214 | | 4/1960 |
| GB | 1150390 | | 4/1969 |
| GB | 1245214 | | 9/1971 |
| GB | 2112281 | A | 7/1983 |
| GB | 2137086 | A | 10/1984 |
| GB | 2169198 | | 7/1986 |
| GB | 2172135 | A | 9/1986 |
| GB | 2178910 | A | 2/1987 |
| GB | 2208336 | A | 3/1989 |
| GB | 2221104 | A | 1/1990 |
| GB | 2396686 | A | 6/2004 |
| JP | H11121123 | A | 4/1999 |
| WO | WO 91/10093 | | 7/1991 |
| WO | WO 96/24966 | | 8/1996 |
| WO | WO 96/26661 | A1 | 9/1996 |
| WO | WO 02/075862 | | 9/2002 |
| WO | WO 2004/008581 | A1 | 1/2004 |
| WO | WO 2007140648 | A1 | 12/2007 |
| WO | WO 2009/115860 | A1 | 9/2009 |

* cited by examiner 202
204
206
208
216
218
220
222
224
226
228
230
232
234
236
240a
240b
242
244
246
246a
246b
248
248a
248b
250
250a
250b
252
264
266
268
270
272
274
276
280
280a
280b
282
124

206b
206a
204

208
222

FIG. 27
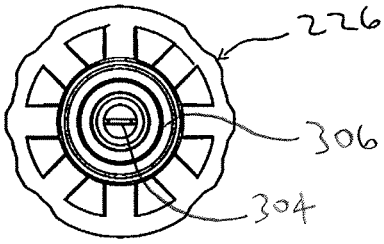
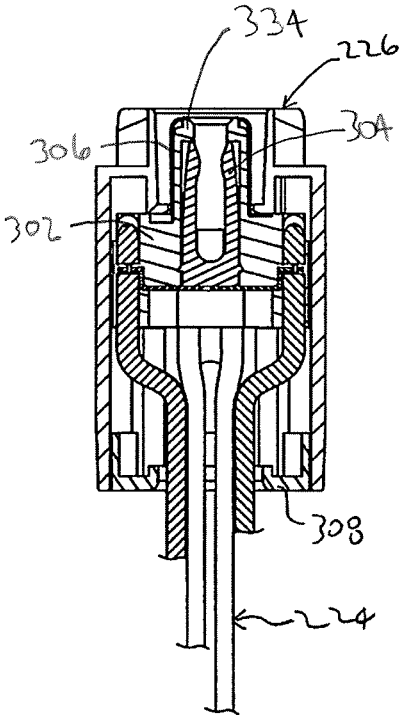
FIG. 24
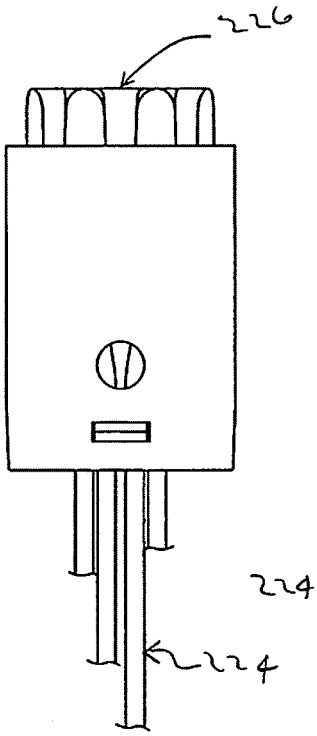
FIG. 25
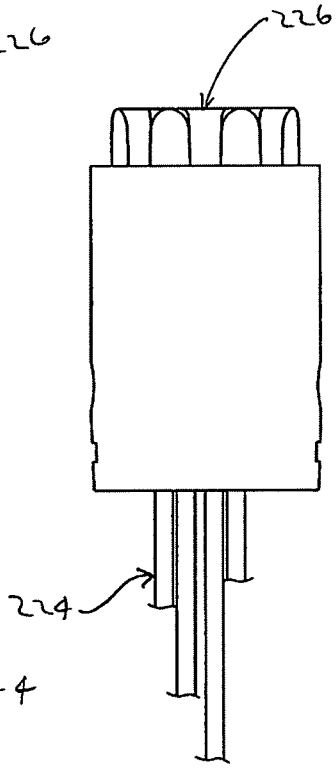
FIG. 26

MODULAR TREE WITH TRUNK CONNECTORS

PRIORITY CLAIM

The present application claims the benefit of U.S. Provisional Application No. 61/780,381 filed Mar. 13, 2013, which is incorporated herein by reference in its entirety.

FIELD OF THE INVENTION

The present invention is generally directed to artificial trees. More specifically, the present invention is directed to artificial trees having separable, modular tree portions mechanically and electrically connectable between trunk portions.

BACKGROUND OF THE INVENTION

Lighted artificial, decorative trees often include light strings attached to the tree branches. Such light strings are generally plugged one into the other either by a consumer while assembling the tree, or by a factory during tree assembly. Typically, all light string wiring, including power cords, are external to the tree trunk, with power cords, plugs, and wiring, extending along the outside of the tree trunk, or distributed about the various portions of the tree. Often, several power cords must be plugged into an external power source to power the light strings of the tree.

Some known lighted trees include a portion of power wiring located inside the tree trunk, with electrical outlets distributed vertically along the trunk. Traditional light strings may be plugged into the trunk outlets in order to power the light strings.

However, as the number of light strings is increased, the wiring volume and complexity also increases, creating challenges relating to power distribution and wire management.

SUMMARY OF THE INVENTION

A lighted artificial tree as that includes a first trunk body, a second trunk body, a first electrical connector, and a second electrical connector. The first electrical connector is housed in the first trunk body, and the second electrical connector is housed in the second trunk body. The first trunk body is configured to couple to the second trunk body, causing the first and second electrical connectors to make electrical connection, the first electrical connector being rotationally locked to the second electrical connector.

BRIEF DESCRIPTION OF THE FIGURES

The invention can be understood in consideration of the following detailed description of various embodiments of the invention in connection with the accompanying drawings, in which:

FIG. 24 is a side sectional view of the trunk electrical hub connector connected to inner-trunk wiring of FIG. 15 in accordance with an embodiment of the invention;

FIG. 25 is a front side view of the trunk electrical hub connector connected to inner-trunk wiring of FIG. 15 in accordance with an embodiment of the invention;

FIG. 26 is a right side view of the trunk electrical hub connector connected to inner-trunk wiring of FIG. 15 in accordance with an embodiment of the invention;

FIG. 27 is a top side view of the trunk electrical hub connector connected to inner-trunk wiring of FIG. 15 in accordance with an embodiment of the invention;

Figure 1:
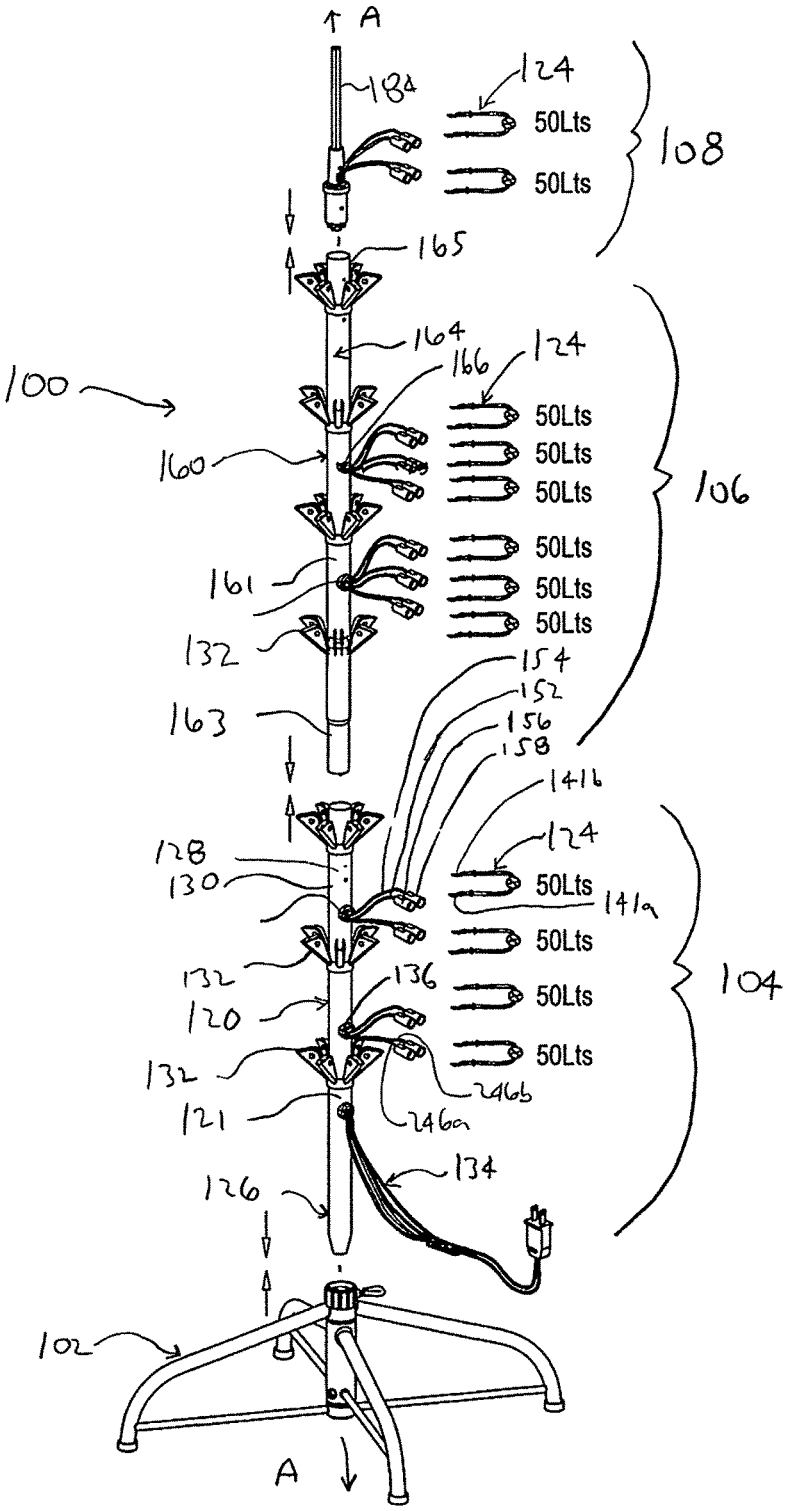
FIG. 1 is an exploded side perspective view of a modular lighted tree in accordance with an embodiment of the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Referring to FIG. 1, an embodiment of modular lighted tree 100 of the present invention is depicted. Modular tree 100 includes base portion 102, first lighted tree portion 104, second lighted tree portion 106, and third lighted tree portion 108. In some embodiments, modular tree 100 may include more tree portions, such as a fourth tree portion, or may include fewer lighted tree portions. When tree 100 is assembled, as depicted, tree portions 104, 106, and 108 are aligned along a common vertical axis A and held in a generally vertical orientation by base portion 102.

As depicted, first lighted tree portion 104 includes first trunk portion 120, multiple branches (see FIG. 3 also), and one or more first light strings 124.

In an embodiment, first trunk portion 120 as depicted comprises a generally cylindrical, hollow structure including trunk body 121 having a first (lower as depicted) end 126, second end 128, outside wall 130, one or more optional branch-support rings 132, and first wiring harness 204. First trunk portion 120, in an embodiment, also defines multiple openings 136 in wall 130, through which portions of wiring harness 204 may pass through. Tree 100 may also include grommets 137 in openings 136 through which portions of wiring harness 204 or light strings 124 pass through. In an embodiment, grommets 137 comprised a rubber material, a plastic material, or another material that prevents insulation of wires from being damaged by edges of trunk body 121 at openings 136. In an embodiment, trunk bodies 121, 161, and 181 comprise a metal material.

Light strings 124 are depicted symbolically in FIG. 1 so as to simplify the drawing; details of light strings 124 are depicted and described further below.

Figure 2:
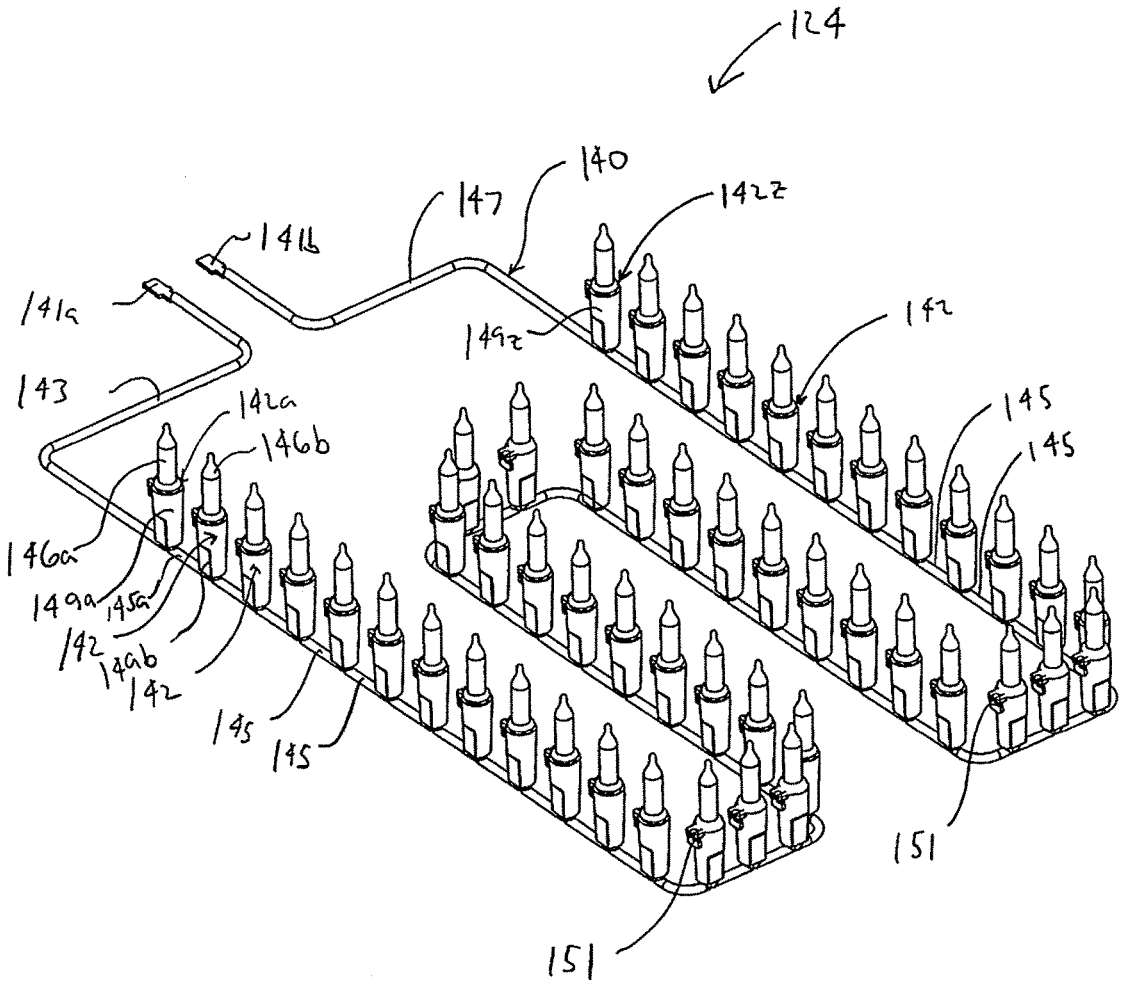
FIG. 2 is a top perspective view of a light string in accordance with an embodiment of the invention.

Referring also to FIG. 2, in an embodiment, each light string includes light string wiring 140 and a plurality of lighting element assemblies 142. Each lighting assembly element 142 includes a housing or lamp holder 149 and lighting element 146. Lighting elements 146 may comprise incandescent bulbs, light-emitting diodes (LEDs), a combination thereof, or any of other known types of light-emitting elements.

As depicted, lighting elements 146 are electrically connected in series, but lighting elements 146 may be electrically connected in parallel, series, or a combination of series and parallel, to form a parallel-connected, series-connected, parallel-series connected, or series-parallel connected first light string 124.

Light string wiring 140, in an embodiment, includes first terminal 141*a*, first or lead wire 143, a plurality of intermediate wires 145, last or return wire 147, and second terminal 141*b*. First terminal 141*a* connected to first wire 143 is connected to a first polarity wire 246*a* of wiring harness 204, and second terminal 141*b* connected to last wire 147 is connected to a second polarity wire 246*b*, such that light string 124, is powered when tree 100 is electrically connected to an external power source. As will be explained further below, in an embodiment, first wire 143 may comprise first polarity wire 246*a* of wiring harness 204, and last wire 147 may comprise second polarity wire 256*b* of wiring harness 204.

In an embodiment, first wire 143 at an end opposite the end having terminal 141*a* is inserted into a first lamp holder 149*a*, and makes electrical contact with a first lead of a lighting element 146*a*. An end of first intermediate wire 145*a* is inserted into a first lamp holder 149*a* making electrical contact with a second lead of the first lighting element 146, and another end of first intermediate wire 145*a* is inserted into a second lamp holder 149*b*, making electrical contact with a first lead of a second lighting element 146*a*. Such mechanical and electrical connections are made for the other intermediate wires 145 and lighting elements 142 to form the light string of the claimed invention. Last wire 147 is electrically connected to a last lighting element 142*z*.

In an alternate embodiment, wiring harness wires 246*a* and 246*b* comprise the lead and return wires, and the lamp holders 156 and 158 depicted in FIG. 1 comprise the first and last lamp holders of light string 124, namely 149*a* and 149*z*.

In such an embodiment, portions of light string 124 are integrated into wiring harness 204. As such, first wire 143 and last wire 147 of light string 124 are attached to an external portion of light string 124, extend through opening 136 in trunk body 121, and integrate and attach to wiring harness 204. In an embodiment, first and last wires 143 extend axially inside trunk body 121 to one of electrical connector 226 or power hub 222. For tree portion 106, first and last wires of the light string also may extend through an opening 166 in trunk body 161, and extend axially to either end of trunk body 161, making an electrical connection with either trunk electrical hub connector 228 or trunk electrical hub connector 232.

As such, light strings 124 are integrated into a wiring harness substantially inside a trunk of a tree 100, making electrical connection to electrical connectors located at ends of their respective tree portions, and to power cord 216.

In the depicted embodiment, first/lead wire 143 and last/return wire 147 extend or enter trunk body 121 (or 161 and so on) through a common opening in the trunk. In other embodiments, wires 143 and 147 may not enter the trunk body at a common opening, but rather, wire 143 may enter at one opening, and wire 147 may enter at another opening. In one such embodiment, lead wire 143 may enter/exit trunk 121 at a first opening 136 at a first tree height, and return wire 147 may enter/exit trunk 121 at a second opening 136 at a second tree height. The first and second tree heights may not be the same.

In the depicted embodiment, first wire 143 and last wire 147 both make electrical connection to a common electrical connector 226 (or 228 or 232, depending on the tree portion). In alternate embodiments, first wire 143 may connect to an electrical connector 226, 228, or 232, while last wire 147 connects to a different electrical connector, at the opposite end of the trunk body. In one such embodiment, first wire 143 and last wire 147 do not connect to a common electrical connector, and do not enter/exit the trunk body through a common opening in the trunk body.

In an alternate embodiment, light string 124 comprises a traditional twisted pair light string 124. Unlike the embodiment depicted in FIG. 2, which comprises a "single-wire" light string since only a single wire connects each pair of lamp holders, with no additional wire twisted about the intermediate wire 145, known twisted-pair light strings have a wiring configuration in which either the lead wire or the return wire is spans nearly the entire length of the light string, and is intertwined, or wrapped about, many of the intermediate wires 145. By twisting a lead or return wire about the intermediate wires, it is less likely that an intermediate wire will be accidentally pulled from one of its lamp holders, and less likely that an intermediate wire will be stretched and broken. While the single-wire design as depicted may lack such extra pull strength, other advantages are realized due to the use of less overall wire, including decreased costs and increased aesthetic appearance.

In another embodiment, light string 124 comprises a series parallel (or parallel series—see also FIG. 44) light string similar to ones depicted and described in US Patent Publication No. US 2012/0075863, having application Ser. No. 13/112,749, and entitled Decorative Light String for Artificial Lighted Tree, which is herein incorporated by reference in its entirety.

In an embodiment, lighting element assemblies 142 may include a lamp lock mechanism 149 on lamp holder 151 to ensure that lighting element 146 does not mistakenly become removed from lamp holder 151.

Figure 3:
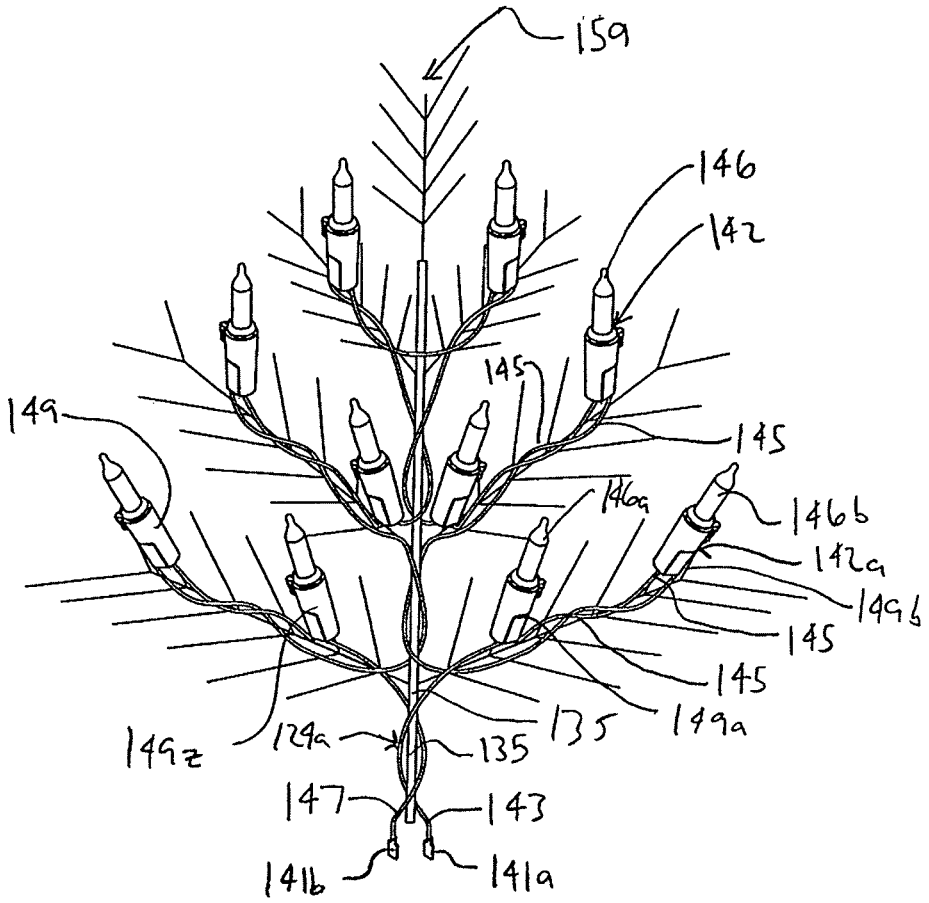
FIG. 3 is a side view of a light string depicted as attached to a branch in accordance with an embodiment of the invention.

Referring specifically to FIG. 3, light string 124 of the claimed invention is depicted as attached to a branch 159. Unlike a twisted pair light string 124 in which a return wire would be twisted around, following the intermediate wires 145 throughout the branch and branch extensions, return wire 147 is twisted about a portion of a branch frame and terminates at last lamp holder 149*z*. Unlike a traditional twisted pair light string 124, intermediate wires 145 may be twisted about one another as shown (recalling that a traditional twisted pair light string twists intermediate wires with either a lead wire or a return wire). In other embodiments, intermediate wires 145 may not be twisted about one another. The resulting effect of not having a return wire 147 twisted about all intermediate wires 145 is that less overall wire may be used since a return wire of light string 124 will be shorter than a return wire that twists about all intermediate wires.

First light string 124 is affixed to one or more branches 159 of lighted tree portion 104 via multiple clips, or simply by twisting about portions of the branch.

In one embodiment, first lighted tree portion 104 includes a plurality of first light strings 124. Such first light strings 124 may be substantially the same, for example, a series-parallel connected light string having 100 lighting element assemblies 142. In other embodiments, first lighted tree portion 104 may include first light strings 124 having a particular configuration and other first light strings 124 having another, different configuration. For example, first light strings 124 located closer to base portion 102 may be longer in length with more light emitting assemblies 142, while first light strings 124 further from base portion 102 may be relatively shorter in length, with fewer light emitting assemblies 142. In other embodiments, first lighted tree portion 104 may include only a single light string 124.

Referring again to FIG. 1, second lighted tree portion 106, adjacent first lighted tree portion 104, is similar to lighted tree portion 104 and includes second trunk portion 160, multiple branches 159 and one or more light strings 124.

Second trunk portion 160 as depicted also comprises a generally cylindrical, hollow structure including trunk body 161 having a first end 163, a second end 165, outside wall 164, and one or more branch-support rings 127. First trunk portion 120 also defines multiple openings 166 in wall 164.

In one embodiment, trunk portion 160 may have a trunk diameter that is substantially equal to a trunk diameter of first trunk portion 120, while in other embodiments, may have a trunk diameter that is different from that of the first trunk portion. In one such embodiment, a trunk diameter of second trunk portion 160 at an end 163 is slightly less than a trunk diameter of first trunk portion 120 such that that trunk 160 at its end has a somewhat tapered look.

Third lighted tree portion 108, adjacent to second lighted tree portion 106 includes third trunk portion 180, branches, and one or more light strings 124. In some embodiments, such as the depicted embodiment, a diameter of third trunk portion 180 may be somewhat smaller in diameter than a diameter of second lighted tree portion 108. As depicted, third trunk portion 180 comprises a relatively smaller diameter pipe-like body portion 184. Also as depicted, in some embodiments, third trunk portion 180 may also not include branch-support rings 127, as branches 160 of third lighted tree portion 108 may be somewhat shorter in length than branches of second lighted tree sections 106 and may be directly connected to body portion 184 of third trunk portion 180.

In the embodiment depicted, third light string 182 emerges from a top opening such that a portion of each light string 124 is within an interior space defined by third trunk portion 180.

Figure 4:
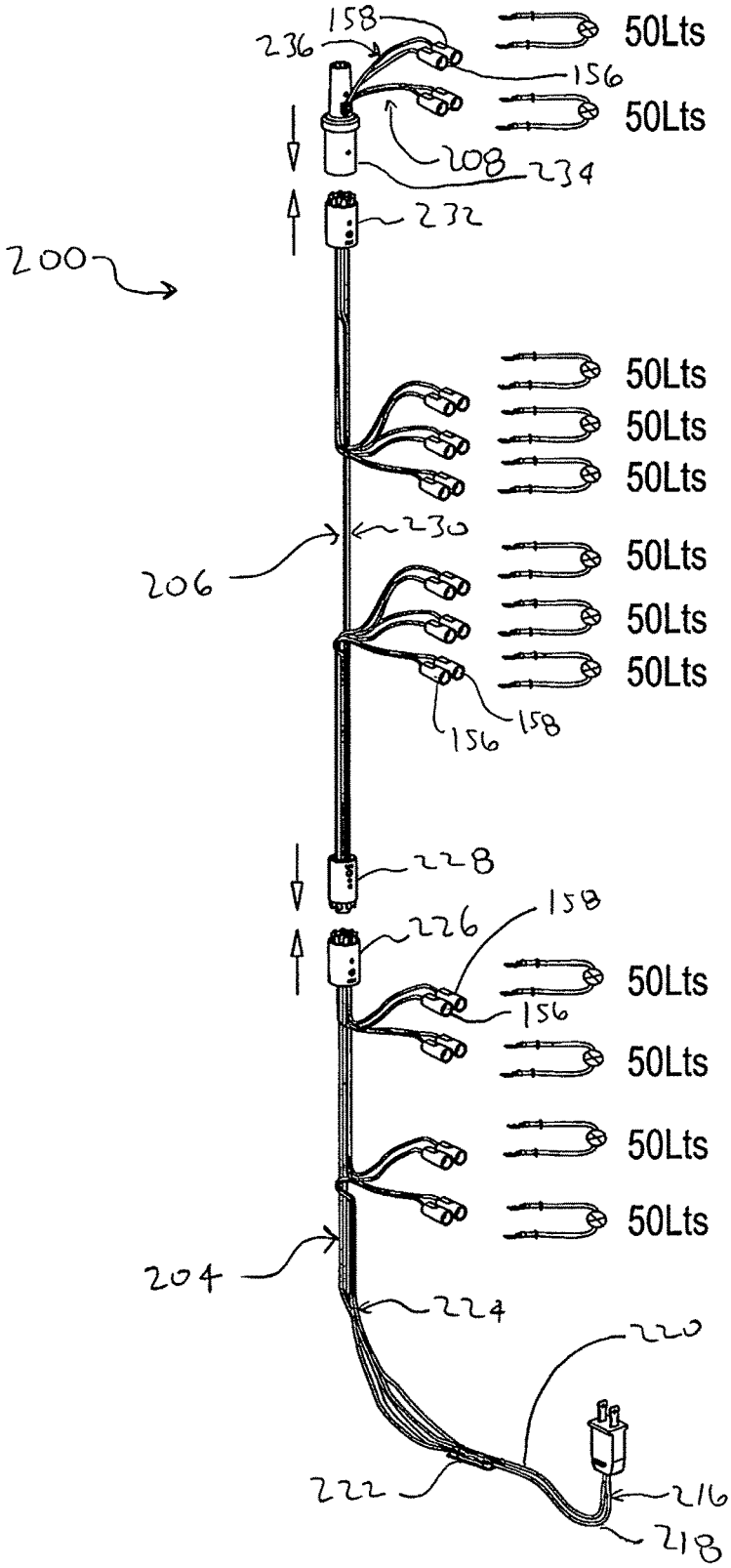
FIG. 4 is a side perspective view of an electrical connection and wiring harness assembly in accordance with an embodiment of the invention.

Referring to FIG. 4, an embodiment of electrical connection and wiring harness assembly 200 is depicted. In an embodiment, electrical connection and wiring harness assembly 200 includes first electrical connection and wiring harness subassembly 204, second electrical connection and wiring harness subassembly 206, and third electrical connection and wiring harness subassembly 208.

In an embodiment, first electrical connection and wiring harness subassembly (first wiring harness) 204 includes power cord 216 with first polarity power cord wiring 218 having one or multiple wires and second polarity power cord wiring 220, also having one or multiple wires, first optional power hub 222, inner-trunk wiring 224, and trunk electrical hub connector 224.

It will be understood that the term "wiring" refers to one or more wires having an inner conductive portion, or conductor, and an outer insulation portion.

First and second polarity power cord wiring 218 and 220 are electrically connected to power hub 222, which in an embodiment may provide one or more inline fuses. Power cord wiring 218 and 220 is electrically connected to inner-trunk wiring 224 and to trunk electrical hub connector 226.

When power cord 216 is electrically connected to an external power source, power is transmitted to light strings 124 and to trunk electrical hub connector 226.

When assembled into trunk portion 120, portions of inner trunk wiring 224 are located inside trunk body 121; trunk electrical hub connector 226 is also located inside trunk body 121, near end 128 (see also FIG. 1).

Second electrical connection and wiring harness subassembly (second wiring harness) 206 includes trunk electrical hub connector 228, inner trunk wiring 230, and trunk electrical hub connector 232. In an embodiment, trunk electrical hub connector 232 is the same as trunk electrical hub connector 226.

Trunk electrical hub connector 228 is electrically connected to inner trunk wiring 230 and to trunk electrical hub connector 232, via inner trunk wiring 230.

When assembled into trunk portion 160, trunk electrical hub connector 228 is located inside trunk body 161 near end 163; all or portions of inner trunk wiring 230 are located inside trunk body 161; and trunk electrical hub connector 232 is located inside trunk body 161 near end 165. (see also FIG. 1)

Trunk electrical hub connector 228 is adapted to mechanically and electrically couple with trunk electrical hub connector 226 when end 163 of trunk portion 160 is inserted into end 128 of trunk portion 120. As such, an electrical connection is made between power cord 216, first wiring harness 204 and second wiring harness 206.

Third wiring harness 208, in the embodiment depicted comprises a simplified wiring harness, and includes trunk electrical hub connector 234 and inner trunk wiring 236.

Trunk electrical hub connector 234 is adapted to mechanically and electrically couple to trunk electrical hub connector 232 when third tree portion 208 is coupled to second tree portion 206, such that an electrical connection is made between second wiring harness 206, first electrical wiring harness 204, and power cord 216.

Consequently, when tree portions 104, 106, and 108 are coupled together along vertical axis A (see also FIG. 1), and when power cord 216 receives power from an external power supply, power is distributed throughout electrical connection and wiring harness assembly 200 spanning all tree portions, and subsequently to light strings 124.

As will become more evident based on the further description of multi-trunk portion wiring harness 200 below, the electrical connection system, wiring harnesses of the claimed invention provide a number of improvements over known systems.

Figures 5, 6, 7:
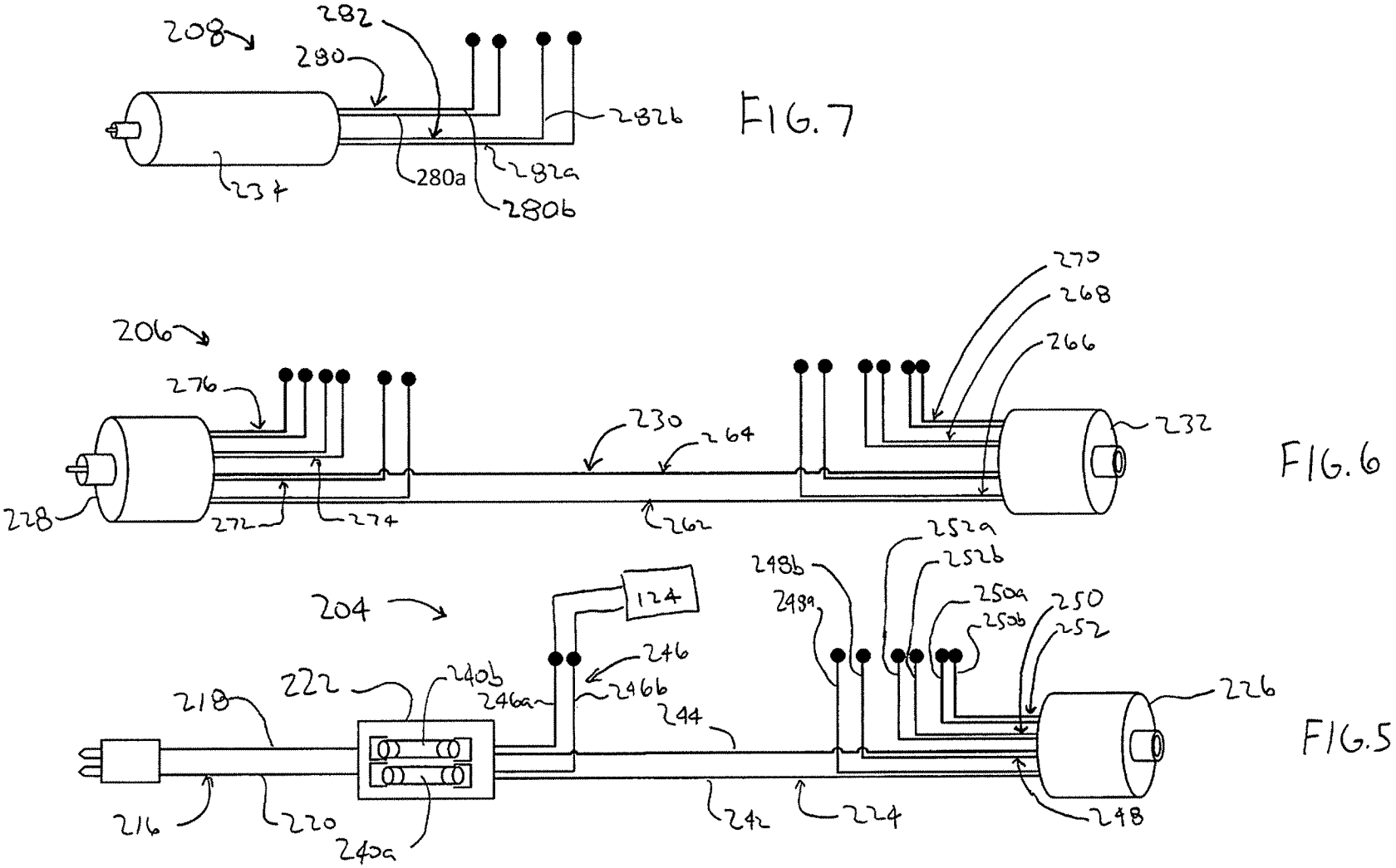
FIG. 5 is a block diagram of an electrical connection and wiring harness subassembly in accordance with an embodiment of the invention.
FIG. 6 is a block diagram of an electrical connection and wiring harness subassembly in accordance with an embodiment of the invention.
FIG. 7 is a block diagram of an electrical connection and wiring harness subassembly in accordance with an embodiment of the invention.

Referring to FIGS. 5-7, block diagrams of each of wiring harnesses 204, 206, and 208 are depicted. Unlike the embodiments of FIGS. 1-4, the embodiments of electrical connectors 226, 228, 232, and 234 as depicted in FIGS. 5-7 do not include a "rotation lock" feature. Structure associated with the rotation-lock feature of the various electrical connectors will be described further below.

Referring specifically to FIG. 5, first wiring harness 204 is depicted. FIG. 5 more clearly depicts the individual wires and wire connections of inner-trunk wiring 224.

In an embodiment, inner-trunk wiring 224 includes a pair of inner-trunk power wires, first polarity inner-trunk power wire 242 and second polarity inner-trunk power wire 244, wherein first and second polarities may correspond to positive and negative (or vice versa), in the case of direct current power, or live and neutral (or vice versa), as in the case of alternating current power, and so on. First polarity inner-trunk power wire 242 and second polarity inner-trunk power wire 244 are electrically connected to power wire 216 and power wire 218, respectively. First polarity inner-trunk power wires 242 and 244 are also electrically connected to electrical connector 226. Consequently power cord 216 is electrically connected to second connector 226 via inner-trunk power wires 242 and 244.

Inner-trunk wiring 224 also includes one or more light-string-power wire sets that provide power to light strings 124. In an embodiment, inner-trunk wiring 224 includes four light-string-power wire sets 246, 248, 250, and 252. Each light-string-power wire set includes two wires for delivering power to its respective light string, one having a first polarity, and one having a second polarity. In such an embodiment, light-string-power wire sets 246, 248, 250, and 252 include light-string power wires 246*a*, 246*b*, 248*a*, 248*b*, 250*a*, 250*a*, 252*a*, and 252*b*, respectively. FIG. 5 depicts a light string 124 connected to light-string-power wire set 246 for context; it will be understood that the other light-string power wire sets are also electrically connected to their respective light strings 124.

It will be understood that the number of light-string-power wire sets will vary depending on the number of light strings 124 to be powered per tree portion. In the embodiment depicted, four light strings 124 require power, though in other embodiments, the number of light strings may be greater or fewer, such that the number of light-string-power wire sets will also be greater of fewer.

As depicted, each pair of light-string-power wire sets is coupled to either power hub 222 and extending axially toward connector 226, or is coupled to trunk electrical hub connector 226 and extending axially toward hub 222. In an embodiment, none of the light-string-power wire sets is coupled to either of inner-trunk power wires 242 or 244. As such, trunk electrical hub connector 226 serves not only as a means for mechanically and electrically coupling tree portions, but also serves as an electrical hub to provide power to light strings 124 via their corresponding light-string-power wire sets. As will be described further below, by coupling light-string-power wire sets to trunk electrical hub connector 226, safe and secure electrical connections to power are made, without having to create a plurality of wire joints along a length of wires 242 and 244 and throughout trunk portion 120.

Referring to FIG. 6, in an embodiment, inner-trunk wiring 230 includes a pair of inner-trunk power wires, first polarity inner-trunk power wire 262 and second polarity inner-trunk power wire 264. First polarity inner-trunk power wires 242 and 244 are electrically connected to electrical connector 228 and 232, extending axially inside trunk body 161 between connectors.

Inner-trunk wiring 230 also includes one or more light-string-power wire sets that provide power to light strings 124. In an embodiment, inner-trunk wiring 230 includes six light-string-power wire sets 266, 268, 270, 272, 274, and 276. Similar to wiring 225, each light-string-power wire set includes two wires for delivering power to its respective light string, one having a first polarity, and one having a second polarity.

In an embodiment that minimizes wire joints, splices, hubs or other electrical connections to power carrying wires traversing the tree portion, each light-string-power wire set is connected to one of connectors 228 or 232 and extends axially inside trunk body 161 away from its corresponding electrical connector. As such all electrical power connections within trunk portion 160 are made at one of the two electrical connectors located at opposite ends of trunk body 160.

Referring to FIG. 7, wiring harness 208 is depicted. In this embodiment, wiring harness 208 includes electrical connector 234 electrically connected to light-string power wire sets 280 and 282. As depicted, wiring harness 208 does not include inner-trunk power wires as tree portion 108 is the topmost tree portion, and all light-string-power wire sets are directly connected to electrical connector 234. In other embodiments, an inner-trunk power wire set carries power to some light-string-power wire sets and light strings 124.

In an embodiment, each light string 124 includes 50 lighting elements 146 electrically connected in series, such that wiring harness 204 powers 200 lights, wiring harness 206 powers 300 lights, and wiring harness 208 powers 100 lights. More or fewer light strings may be used, and more or fewer lighting elements per light string be used.

Figures 8, 9, 10:
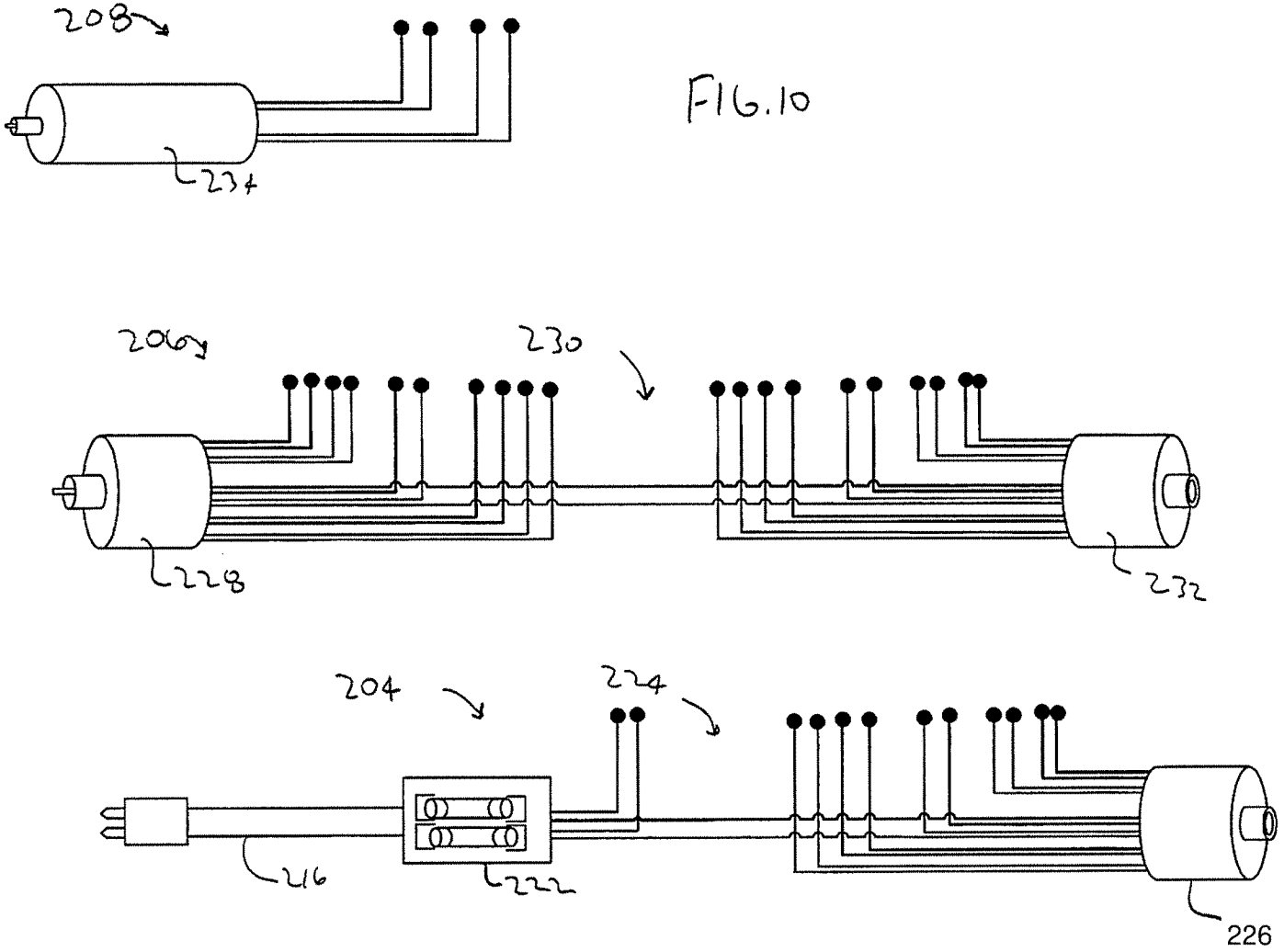
FIG. 8 is a block diagram of an electrical connection and wiring harness subassembly in accordance with an embodiment of the invention.
FIG. 9 is a block diagram of an electrical connection and wiring harness subassembly in accordance with an embodiment of the invention.
FIG. 10 is a block diagram of an electrical connection and wiring harness subassembly in accordance with an embodiment of the invention.
Figures 11, 12, 13, 14:
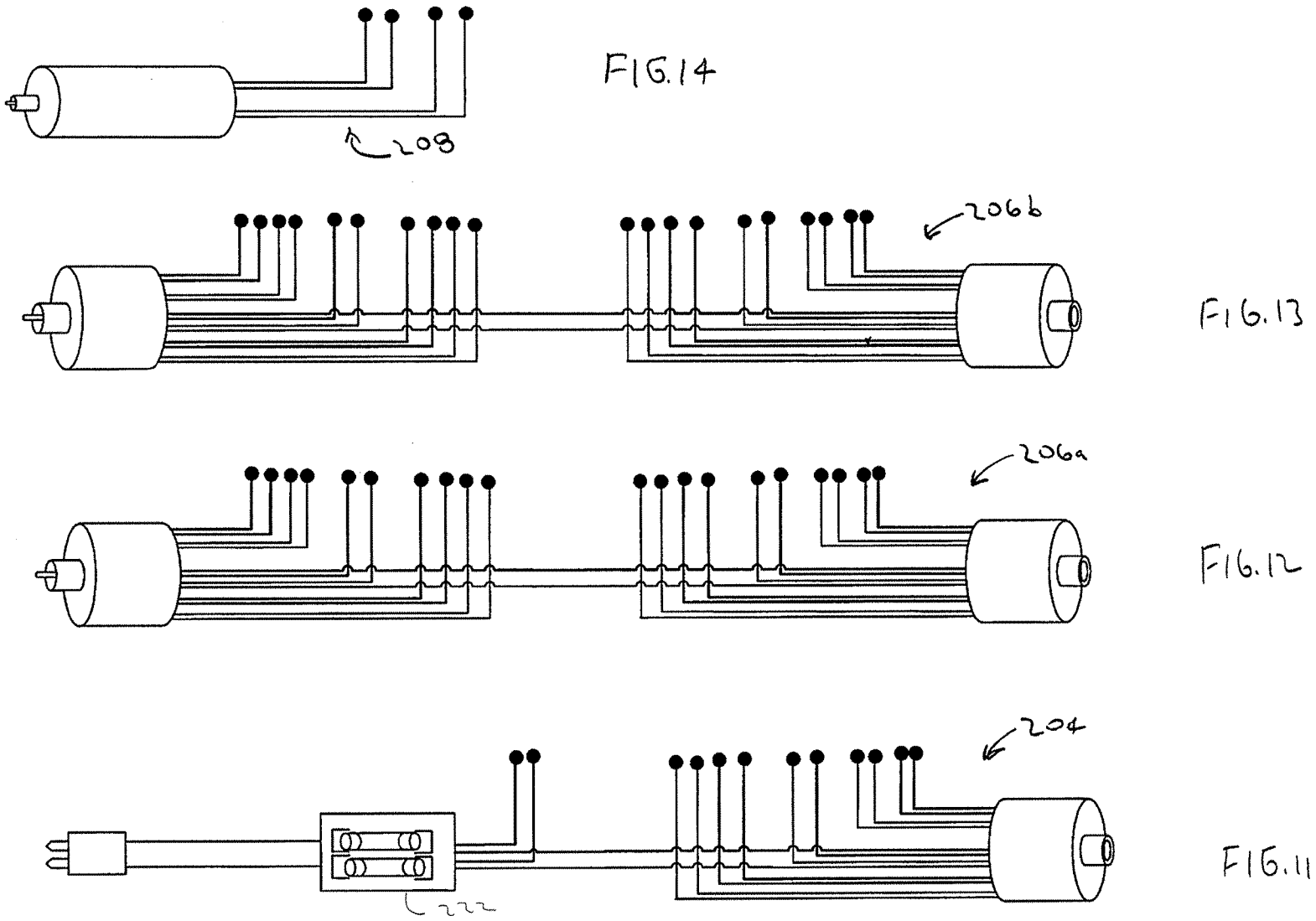
FIG. 11 is a block diagram of an electrical connection and wiring harness subassembly in accordance with an embodiment of the invention.
FIG. 12 is a block diagram of an electrical connection and wiring harness subassembly in accordance with an embodiment of the invention.
FIG. 13 is a block diagram of an electrical connection and wiring harness subassembly in accordance with an embodiment of the invention.
FIG. 14 is a block diagram of an electrical connection and wiring harness subassembly in accordance with an embodiment of the invention.

Referring to FIGS. 8-10, embodiments of wiring harnesses 204, 206, and 208 powering fewer light strings 124 as compared to the embodiments of FIGS. 5-7 are depicted. In the depicted embodiment, wiring harness 204 is configured to provide power to six light strings 124, wiring harness 206 is configured to provide power to ten light strings 124, and wiring harness 208 is configured to provide power to two light strings 124.

Referring to FIGS. 11-14, embodiments of wiring harnesses 204, 206*a*, 206*b*, and 208 are depicted. In this embodiment, tree 100 includes four tree portions, rather than three tree portions, such that a fourth wiring harness is added.

Referring to FIGS. 15-26, various views of trunk electrical hub connector 226 is depicted.

Figures 15, 16, 17:
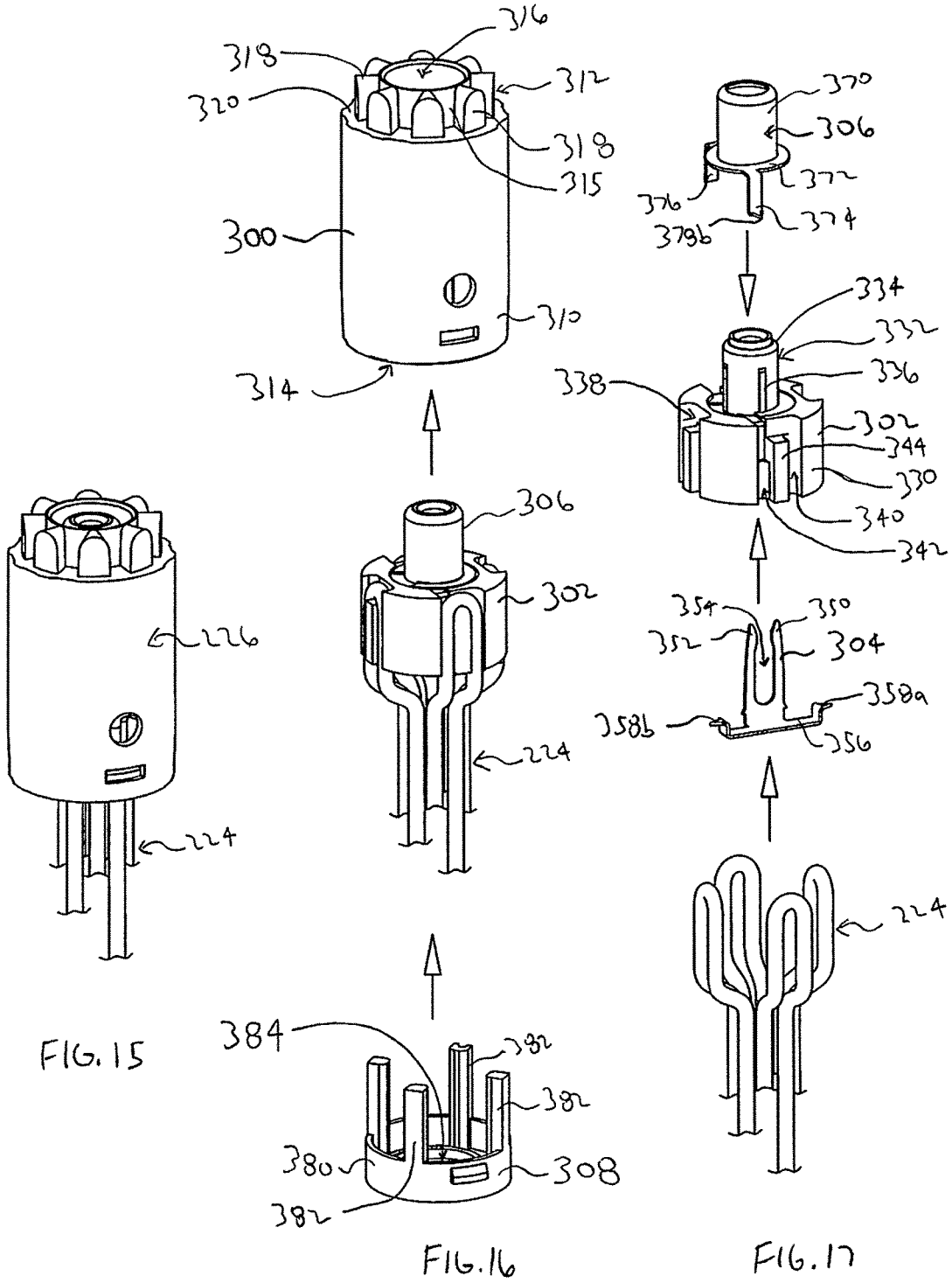
FIG. 15 is a side perspective view of a trunk electrical hub connector connected to inner-trunk wiring in accordance with an embodiment of the invention.
FIG. 16 is a partially exploded side perspective view of the trunk electrical hub connector connected to inner-trunk wiring of FIG. 15 in accordance with an embodiment of the invention.
FIG. 17 is an exploded side perspective view of a portion of the trunk electrical hub connector connected to inner-trunk wiring of FIG. 15 in accordance with an embodiment of the invention.

Referring to FIG. 15, trunk electrical hub connector 226 assembled and connected to inner-trunk wiring 224 is firstly depicted; FIGS. 16 and 17 depict partially exploded views of trunk electrical hub connector 226 and inner-trunk wiring 224.

Referring to FIGS. 16-17, trunk electrical hub connector 226 in an embodiment includes housing 300, wire retainer 302, first polarity electrical terminal 304, second polarity electrical terminal 306, and end cap 308.

Housing 300 in an embodiment comprises a generally cylindrically shape defining a generally circular cross-sectional shape, such that housing 300 may be inserted into a trunk body 121 or 161 receiving cavity. In other embodiments, housing 300 may comprise other shapes adapted to fit into trunk body 121 or 161.

In an embodiment, housing 300 comprises a non-conductive material such as polypropylene, polyethylene, nylon, and so on.

Housing 300 includes proximal end 310 and distal end 312 and defines wire-retainer cavity 314 and first terminal cavity 316. As depicted, distal end 312 includes projecting wall 315, a plurality of tooth-like projections 318 circumferentially distributed about, and upon, surface 320. As will be explained further below, when coupled with connector 228 having similar tooth-like projections, connectors 226 and 232 will generally be rotationally locked relative to one another.

Wire retainer 302 in an embodiment comprises a non-conductive or insulating material, and includes distal end 330 and proximal end 332. Distal end 330, in an embodiment, comprises a generally cylindrical projection 334 projecting axially and away from proximal end 332. In an embodiment, projection 334 includes axial retaining ridges 336 on an outside surface. Proximal end 330 in an embodiment comprises a generally disc-like shape, and defines a plurality of axial wire-set-receiving recesses 338. As depicted, proximal end 330 includes four wire-set-receiving recesses 338, one adapted to receive inner-trunk power wires comprising first polarity wire 242 and second polarity wire 244, and three recesses to receive three light-string-power wire sets 248, 250, and 252, respectively.

Each wire-set-receiving recess 338 includes a pair of wire recesses 340 and 342 separated by wire-separating block 344. Wire recesses 340 and 342 are sized to receive a wire of wiring 224

In an embodiment, first electrical terminal 304 forms a contiguous conductor having a pair of upwardly projecting projections 350 and 352 that define receiving spade 354, and form a fork-like shape. Terminal 304 also includes a base portion 356 that include stepped, opposing wire-insulation-piercing members 358*a* and 358*b*.

In an embodiment, second electrical terminal 306 includes cylindrical portion 370, base portion 372, and tabs 374 and 376. Tabs 374 include wire-insulation-piercing members 378*a* and 378*b*. Terminal 306 generally comprises a conductive material.

Cylindrical portion 370 projects upward and away from base portion 372. Tabs 374 and 376 generally extend transversely downward and away from base portion 356.

End cap 308 comprises a generally non-conductive material, includes base portion 380 and a plurality of upwardly projecting extensions 382, and defines wire aperture 384.

Figure 18:
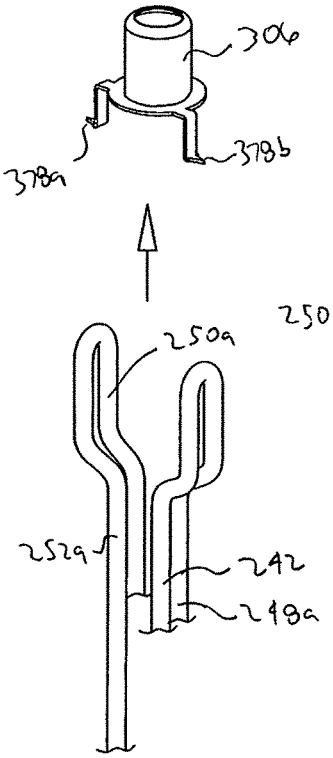
FIG. 18 is an exploded side perspective view of an electrical terminal and power wiring connection of the trunk electrical hub connector connected to inner-trunk wiring of FIG. 15 in accordance with an embodiment of the invention.
Figure 19:
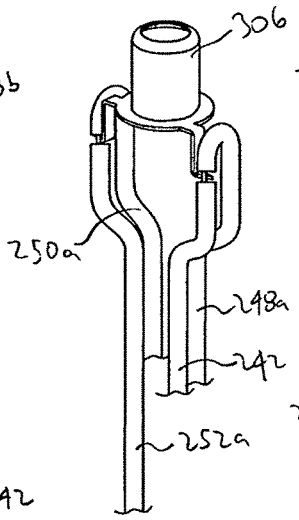
FIG. 19 is a side perspective view of the electrical terminal and power wiring connection of FIG. 18.

Referring to FIGS. 18 and 19, first electrical terminal 306 makes electrical contact with first polarity power wire 242, and first polarity light-string-power wires 248*a*, 250*a*, and 252*a*. In an embodiment, wire-insulation-piercing tab 378*b* pierces an insulation of first polarity power wire 242, and wires 248*a*, 250*a*, and 252*a* are neutral wires. As depicted, wire 242 and 248*a* in an embodiment comprise a single, continuous wire that is looped at terminal 306 to form two parallel portions, namely wire 242 and 248*a*. Similarly, wires 250*a* and 252*a* comprise a single, continuous wire looped at second electrical terminal 306.

Wire-insulation-piercing member 378*b* pierces an insulation of wire 242 to make electrical contact with a conductor of first polarity power wire 242. Wire-insulation-piercing member 378*a* pierces one of light-string-power wires 250*a* or 252 (252*a* as depicted). Due to the conductive properties of second electrical terminal 306, all four wires are in electrical connection with each other and with terminal 306.

The wire-insulting-piercing properties of terminal 306 reduces manufacturing assembly time, eliminates a wire joint that could loosen over time, and that could arc if not properly connected or soldered.

Figure 20:
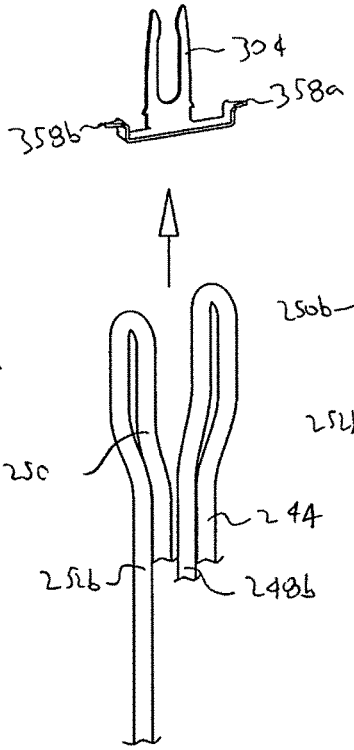
FIG. 20 is an exploded perspective view of an electrical terminal and polarity power wiring connection of the trunk electrical hub connector connected to inner-trunk wiring of FIG. 15 in accordance with an embodiment of the invention.
Figure 21:
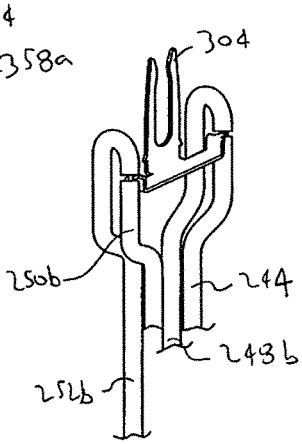
FIG. 21 is a side perspective view of the electrical terminal and polarity power wiring connection of FIG. 20.

Referring to FIGS. 20 and 21, first wire terminal 304 is depicted piercing second polarity power wire 244 and wire 250*b*, causing electrical connection between wires 244, 248*b*, 250*b*, and 252*b*. In an embodiment, second polarity wire 244 is a "live" or "hot" wire in the case of alternating current (AC) supply power. In an alternate embodiment, first and second polarity may refer to a positive and negative polarity as provided by a direct current (DC) power source.

Although first and second electrical terminals 304 and 306 are depicted as wire-insulating-piercing terminals, it will be understood that in alternate embodiments, terminals 304 and 306 may comprise other types of electrical terminals, or electrical connectors that could join a pair of wires or wire segments.

Figure 22:
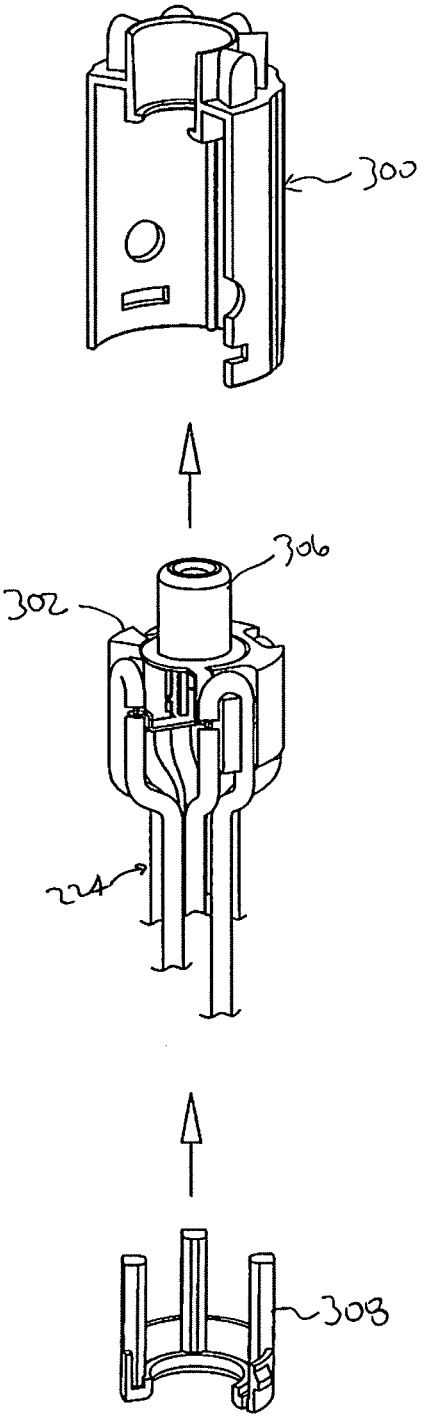
FIG. 22 is a partially exploded partial sectional perspective view of the trunk electrical hub connector connected to inner-trunk wiring of FIG. 15 in accordance with an embodiment of the invention.

Referring to FIG. 22, an exploded view of trunk electrical hub connector 226 in partial cross section is depicted. As depicted, first and second electrical terminals 304 and 306 are secured and held stationary by wire retainer 302. Wires are received by received by wire recesses 338. During assembly, wires are pressed into wire recesses 338 about block 344, and pressed against wire-insulation-piercing terminals such that the insulation is pierced as described above.

Figure 23:
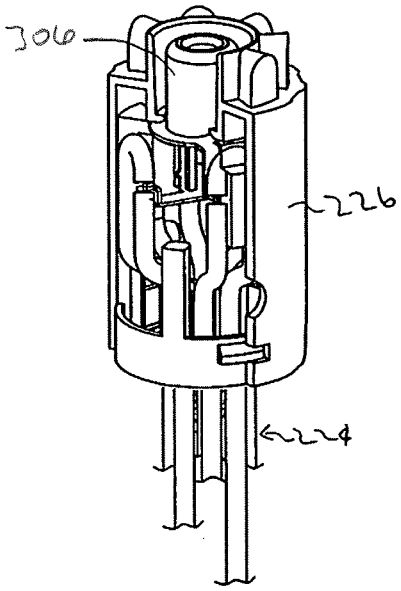
FIG. 23 is a partial sectional perspective view of the trunk electrical hub connector connected to inner-trunk wiring of FIG. 15 in accordance with an embodiment of the invention.

Referring to FIGS. 23 and 24, additional depictions of electrical connector 226 in cross section are depicted.

FIG. 25 depicts a front view of electrical connector 226 with wiring 224; FIG. 26 depicts a right-side view of electrical connector 226, and FIG. 27 depicts a top view of electrical connector 226.

Referring to FIGS. 28-38, an embodiment of trunk electrical hub connector 228 is depicted.

Figure 28:
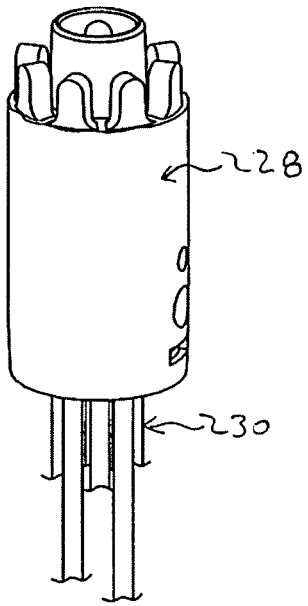
FIG. 28 is a side perspective view of a trunk electrical hub connector connected to inner-trunk wiring in accordance with an embodiment of the invention.
Figure 29:
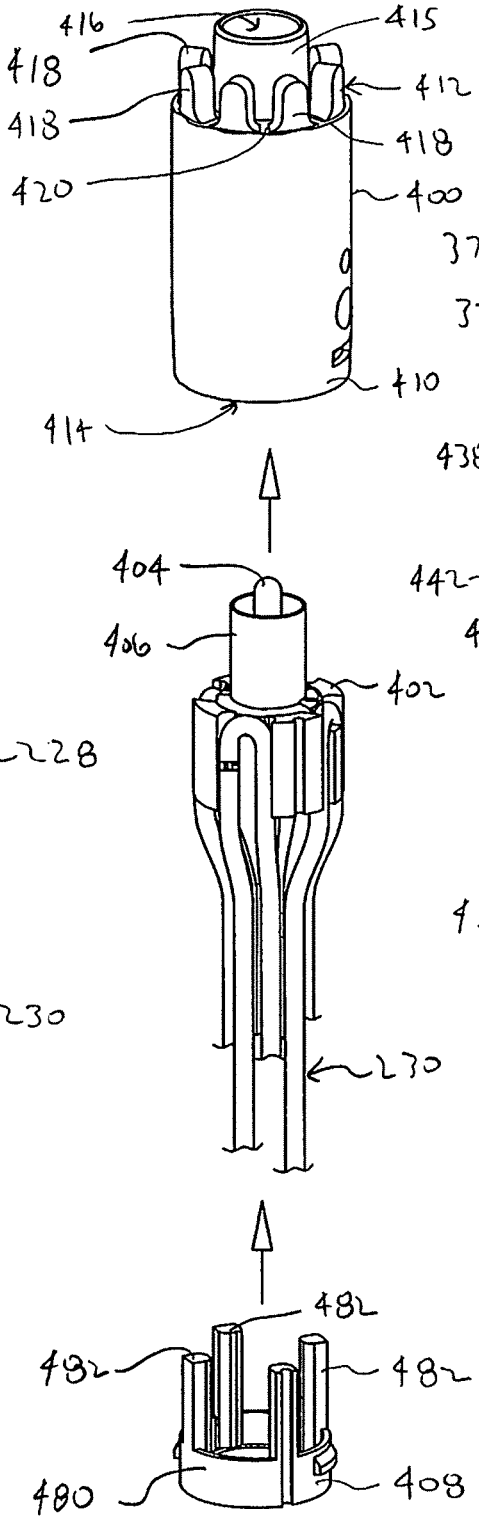
FIG. 29 is a partially exploded side perspective view of the trunk electrical hub connector connected to inner-trunk wiring of FIG. 28 in accordance with an embodiment of the invention.
Figure 30:
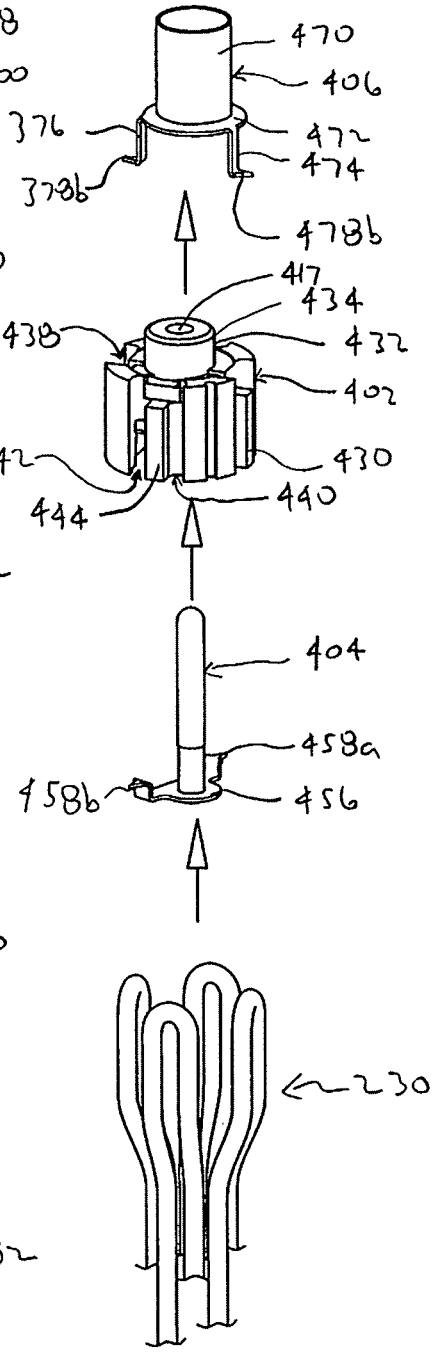
FIG. 30 is an exploded side perspective view of a portion of the trunk electrical hub connector connected to inner-trunk wiring of FIG. 28 in accordance with an embodiment of the invention.

Referring to FIG. 28, trunk electrical hub connector 228 assembled and connected to inner-trunk wiring 224 is firstly depicted; FIGS. 29 and 30 depict partially exploded views of trunk electrical hub connector 228 and inner-trunk wiring 230.

Referring to FIGS. 29 and 30, trunk electrical hub connector 228 in an embodiment includes housing 400, wire retainer 402, first polarity electrical terminal 404, second polarity electrical terminal 406, and end cap 408.

Generally, in an embodiment, and as depicted, trunk electrical hub connector 228 may be considered a "male" connector in that first polarity electrical terminal 404, in an embodiment, comprises a center, pin terminal. In contrast, and in an embodiment, trunk electrical hub connector 226 may be considered a "female" connector in that its two electrical terminals 304 and 306 receive the two electrical terminals 404 and 406.

Housing 400 in an embodiment comprises a generally cylindrically shape defining a generally circular cross-sectional shape, such that housing 400 may be inserted into trunk body 121 or 161 receiving cavity. In other embodiments, housing 400 may comprise other shapes adapted to fit into trunk body 121 or 161. In an embodiment, housing 400 of trunk electrical hub connector 228 may have a smaller diameter than housing 300 of trunk electrical hub connector 226, as electrical connector 228 is inserted into end 163 which is narrower than end 128, such that end 163 fits into end 128.

In an embodiment, housing 400 comprises a non-conductive material such as polypropylene, polyethylene, nylon, and so on.

Housing 400 includes proximal end 410 and distal end 412 and defines wire-retainer cavity 414 and first terminal cavity 416. As depicted, distal end 412 includes projecting wall 415, a plurality of tooth-like projections 418 circumferentially distributed about, and upon, surface 420. As will be explained further below, when coupled with connector 226 having similar, complementary tooth-like projections, connectors 226 and 228 will generally be rotationally locked relative to one another.

Wire retainer 402 in an embodiment comprises a non-conductive or insulating material, and includes distal end 430 and proximal end 432. Distal end 430, in an embodiment, comprises a generally cylindrical projection 434 projecting axially and away from proximal end 432, and defining a central terminal receiving aperture 417. Proximal end 430 in an embodiment comprises a generally disc-like shape, and defines a plurality of axial wire-set-receiving recesses 438. As depicted, proximal end 430 includes four wire-set-receiving recesses 438, one adapted to receive inner-trunk power wires comprising first polarity wire 262 and second polarity wire 264, and three recesses to receive three light-string-power wire sets 272, 274, and 276, respectively.

Each wire-set-receiving recess 438 includes a pair of wire recesses 440 and 442 separated by wire-separating block 444. Wire recesses 440 and 442 are sized to receive a wire of wiring 230.

In an embodiment, first electrical terminal 404 forms a contiguous conductor having a central pin-like terminal 450. Terminal 404 also includes a base portion 456 that includes stepped, opposing wire-insulation-piercing members 458*a* and 458*b*.

In an embodiment, second electrical terminal 406 includes cylindrical portion 470, base portion 472, and tabs 474 and 476. Tabs 474 include wire-insulation-piercing members 478*a* and 478*b*. Terminal 406 generally comprises a conductive material.

Cylindrical portion 470 projects upward and away from base portion 472. Tabs 474 and 476 generally extend transversely downward and away from base portion.

End cap 408 comprises a generally non-conductive material, includes base portion 480 and a plurality of upwardly projecting extensions 482, and defines wire aperture 484.

Figure 31:
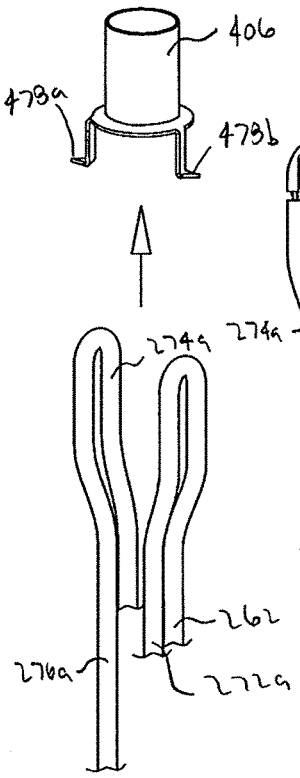
FIG. 31 is an exploded side perspective view of an electrical terminal and polarity power wiring connection of the trunk electrical hub connector connected to inner-trunk wiring of FIG. 28 in accordance with an embodiment of the invention.
Figure 32:
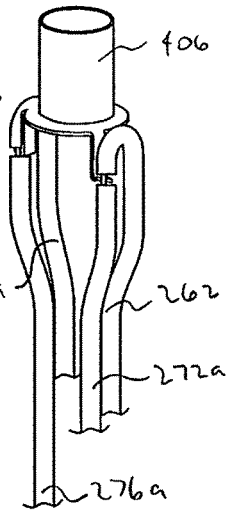
FIG. 32 is a side perspective view of the electrical terminal and polarity power wiring connection of FIG. 31.

Referring to FIGS. 31 and 32, first electrical terminal 406 makes electrical contact with first polarity power wire 262, and first polarity light-string-power wires 272*a*, 274*a*, and 276*a*. In an embodiment, wires 262, wire-insulation-piercing tabs 478*b* pierces an insulation of first polarity power wire 262 and wires 272*a*, 274*a*, and 276*a* are neutral wires. As depicted, wire 262 and 272*a* in an embodiment comprise a single, continuous wire that is looped at terminal 406 to form two parallel portions, namely wire 262 and 272*a*. Similarly, wires 274*a* and 276*a* comprise a single, continuous wire looped at second electrical terminal 406.

Wire-insulation-piercing member 478*b* pierces an insulation of wire 242 to make electrical contact with a conductor of first polarity power wire 262. Wire-insulation-piercing member 478*a* pierces one of light-string-power wires 274*a* or 276*a* (276*a* as depicted). Due to the conductive properties of second electrical terminal 406, all four wires are in electrical connection with each other and with terminal 406.

The wire-insulation piercing properties of terminal 406 reduce manufacturing assembly time and eliminate wire joints that could loosen over time, and that could arc if not properly connected or soldered.

Figure 33:
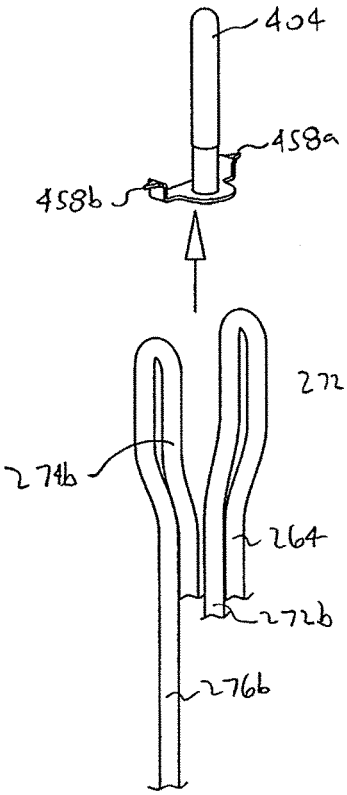
FIG. 33 is an exploded side perspective view of an electrical terminal and polarity power wiring connection of the trunk electrical hub connector connected to inner-trunk wiring of FIG. 28 in accordance with an embodiment of the invention.
Figure 34:
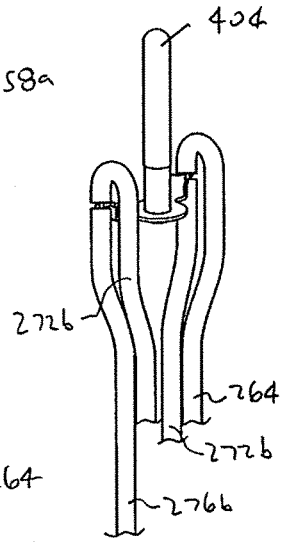
FIG. 34 is a side perspective view of the electrical terminal and polarity power wiring connection of FIG. 33.

Referring to FIGS. 33 and 34, first wire terminal 404 is depicted piercing second polarity power wire 264 and wire 272*b*, causing electrical connection between wires 264, 272*b*, 274*b*, and 276*b*. In an embodiment, second polarity wire 264 is a "live" or "hot" wire in the case of alternating current (AC) supply power. In an alternate embodiment, first and second polarity may refer to a positive and negative polarity as provided by a direct current (DC) power source.

Although first and second electrical terminals 404 and 406 are depicted as wire-insulation-piercing terminals, it will be understood that in alternate embodiments, terminals 404 and 406 may comprise other types of electrical terminals, or electrical connectors that could join a pair of wires or wire segments.

Figure 35:
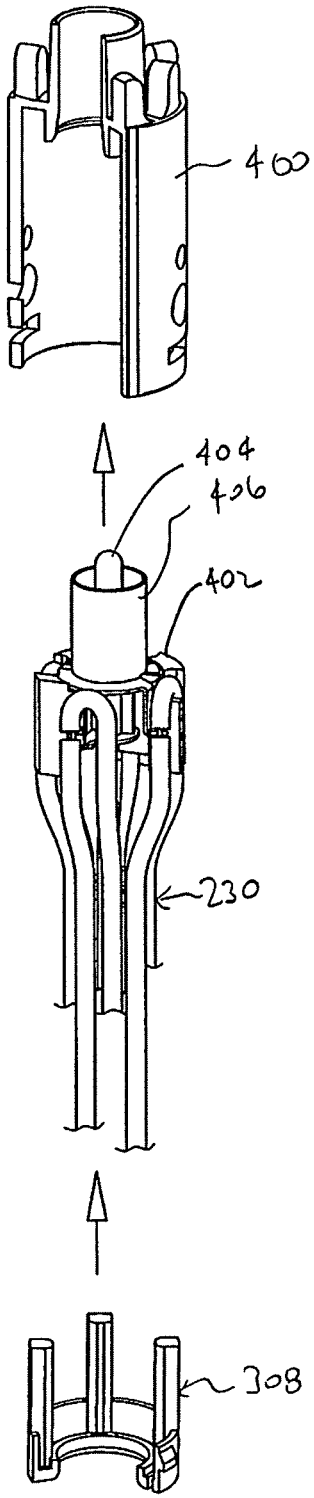
FIG. 35 is a partially exploded partial sectional perspective view of the trunk electrical hub connector connected to inner-trunk wiring of FIG. 28 in accordance with an embodiment of the invention.

Referring to FIG. 35, an exploded view of trunk electrical hub connector 226 in partial cross section is depicted. As depicted, first and second electrical terminals 404 and 406 are secured and held stationary by wire retainer 402. Wires are received by received by wire recesses 438. During assembly, wires are pressed into wire recesses 438 about block 444, and pressed against wire-insulation-piercing terminals such that the insulation is pierced as described above.

Figure 36:
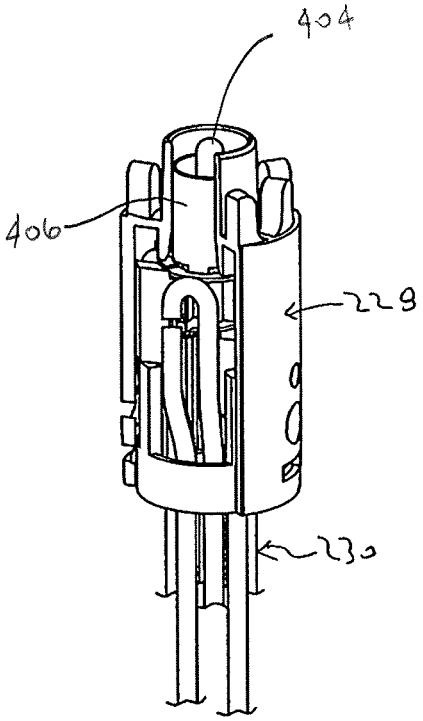
FIG. 36 is a partial sectional side perspective view of the trunk electrical hub connector connected to inner-trunk wiring of FIG. 28 in accordance with an embodiment of the invention.
Figure 37:
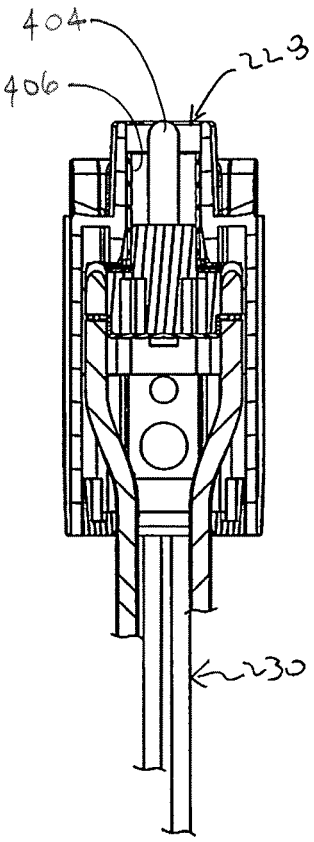
FIG. 37 is a side sectional view of the trunk electrical hub connector connected to inner-trunk wiring of FIG. 28 in accordance with an embodiment of the invention

Referring to FIGS. 36 and 37, additional depictions of electrical connector 226 in cross section are depicted.

Figure 39:
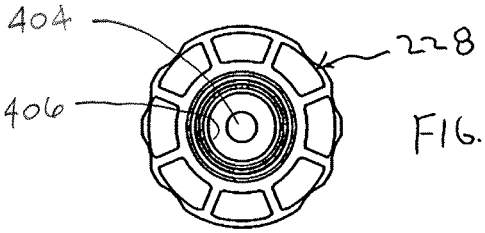
FIG. 39 is a top side view of the trunk electrical hub connector connected to inner-trunk wiring of FIG. 28 in accordance with an embodiment of the invention.
Figure 38:
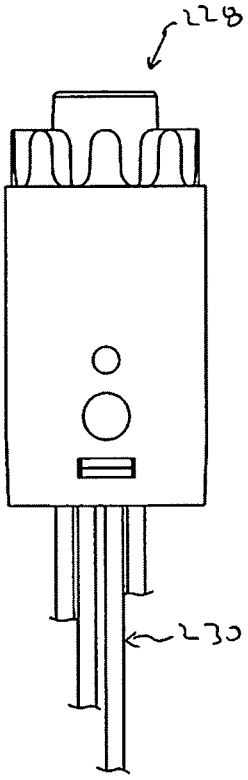
FIG. 38 is a front side view of the trunk electrical hub connector connected to inner-trunk wiring of FIG. 28 in accordance with an embodiment of the invention.

FIG. 38 depicts a front view of electrical connector 228 with wiring 230, and FIG. 39 depicts a top view of electrical connector 228.

Figure 40:
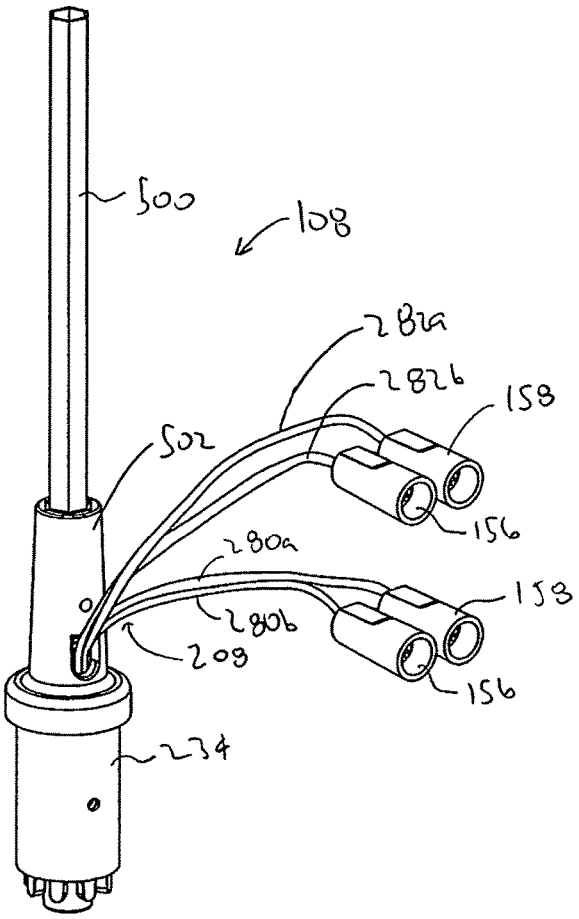
FIG. 40 is a side perspective view of a lighted tree portion of the modular lighted tree of FIG. 1 in accordance with an embodiment of the invention.
Figure 41:
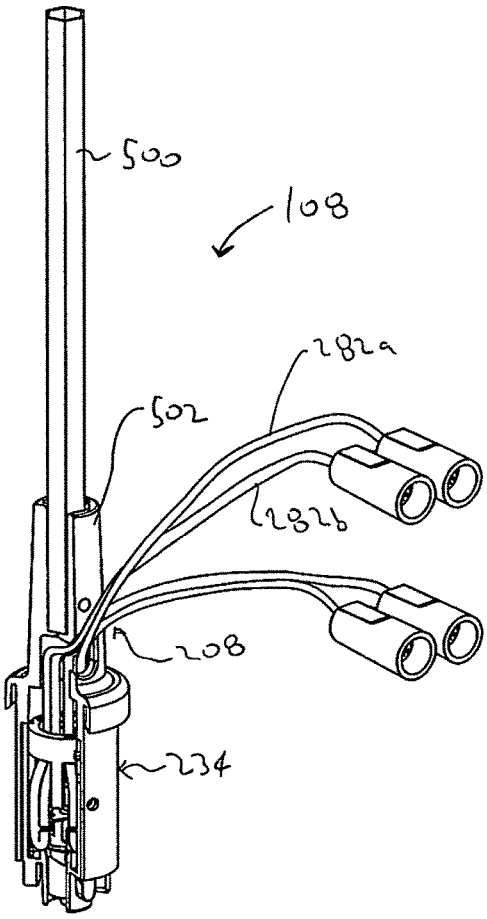
FIG. 41 is a partial sectional perspective view of the lighted tree portion of FIG. 40 in accordance with an embodiment of the invention.

Referring to FIGS. 40 and 41, tree portion 108 with connector 234, wiring harness assembly 208 with wiring 236, mast 500 and mast support cap 502 is depicted.

Wiring harness assembly includes trunk electrical hub connector 234, which in an embodiment is substantially the same as trunk electrical hub connector 228, with the exception of the addition of mast support cap 502.

Referring also to FIGS. 1-4, as described above, when tree portions 104, 106, and 108 are coupled together, a portion of trunk body 161 fits into trunk body 121, such that a mechanical connection or coupling is made between trunk bodies 121 and 161. At the same time, trunk electrical hub connector 226 electrically couples with trunk electrical hub connector 228, thusly providing power throughout tree 100.

In addition to the electrical coupling taking place between connectors 226 and 228, a mechanical coupling between connectors 226 and 228 also occurs. In the embodiments described above, male and female portions of connectors 226 and 228 are inserted one into another axially, along Axis A, creating one type of mechanical coupling or connection within the interior of tree 100 and its trunk (as opposed to mechanical connection between the metal walls of the trunk bodies at a periphery of the trunk). However, a second form of mechanical coupling may also occur in embodiments of electrical connectors 226 and 228 having rotation-lock features, such as those provided by the tooth-like features 318 and 418 as depicted in FIGS. 16 and 29.

Figure 42:
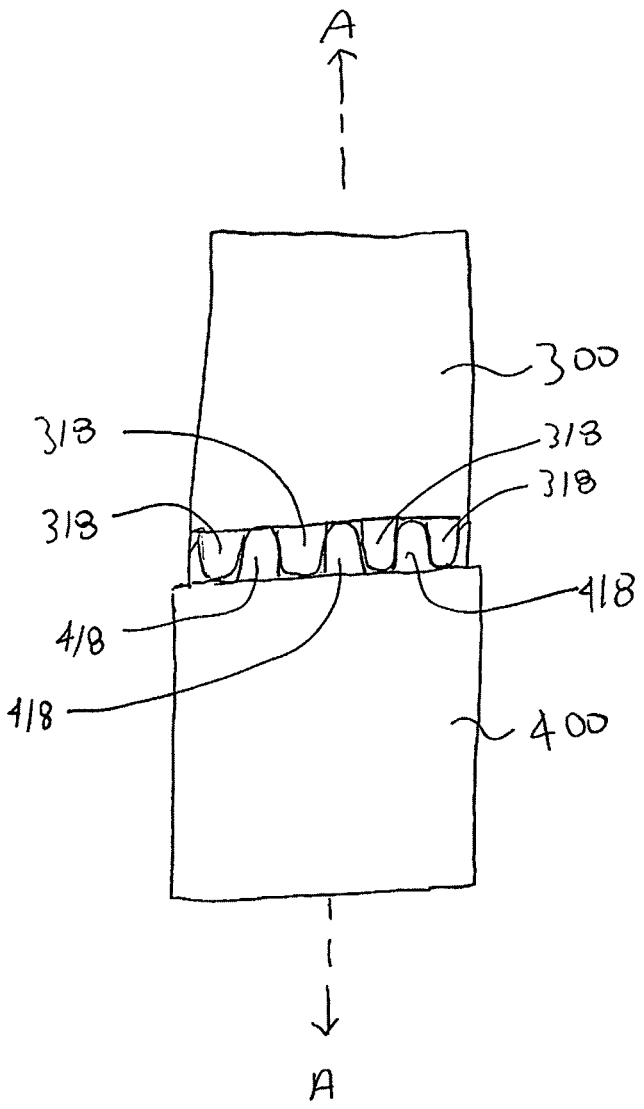
FIG. 42 is a front side view of a housing of an electrical connector coupled to another housing of an electrical connector in accordance with an embodiment of the invention.

Referring to FIG. 42, a front view of housing 300 of electrical connector 226 coupled to housing 400 of electrical connector 228 is depicted. As illustrated, projections 318 extend into gaps between projections 418, and likewise, projections 418 extend into gaps between projections 318. As such, without the presence of an upward axial force, housing 300 is unable to rotate about Axis A relative to housing 400. Consequently, tree portion 104 is unable to rotate about tree portion 106.

This rotation-lock feature provides a number of advantages. Firstly, by preventing a relative rotation of tree portions about Axis A, potential damage to light strings and decorative items attached to and distributed across tree portions is also prevented. Additionally, maintaining a rotational orientation or alignment of tree portions retains the original decorative look of the tree. For example, tree 100 may be placed in a corner, and only an outward facing set of branches includes ornaments, garland, and the like.

Secondly, the rotation-lock feature enables rotation locking but allows a user to align tree portion 104 (and connector 226) with tree portion 106 (and connector 228) in one or more of a plurality of rotational alignments enables ease of assembly. In the case of large, heavy trees, if a user must align two tree portions in only one, or two available rotational alignments, it may be difficult or unwieldy to hold the top tree portion, for example tree portion 106, above tree portion 104, and rotate tree portion 106 until it is rotationally aligned with tree portion 104.

However, if a user can initially insert end 163 into end 128, lower tree portion 104, then rotate tree portion 104 to align connectors 104 and 106, tree portion 104 and tree portion 106 can be easily coupled. Further, in the embodiment of housings 300 and 400 above having projections 318 and 418 with rounded ends, the axial force of the weight of tree 104 bearing on the rounded ends of projections 318 and 418 contacting each other in imperfect alignment may cause tree portion 104 to rotate about Axis A and fall into rotational alignment.

Embodiments of trunk electrical hub connectors 226 and 228 having rotation-lock features are not limited to those described above and depicted in the figures. In alternate embodiments, housings 300 and 400 may include rotation-lock structure different from projections 318 and 418. Embodiments of other projections 318/418 and structure may include projections on one connector fitting into recesses of another connector, complementary V-shaped projections (rather than "U" shaped as depicted and described above), spherical projections, ridges and slots, complementary ridges, and so on.

Referring to FIGS. 43-75 an alternate embodiment of tree 100 is depicted. Generally, the alternate embodiment of tree 100 of FIGS. 43-75 is substantially the same as tree 100 described above with respect to FIGS. 1-42. Some notable differences include features of wiring harnesses 204 and 208, features for attaching light strings to wiring harnesses, and features for attaching individual wires to electrical connectors 226 and 228.

Figure 43:
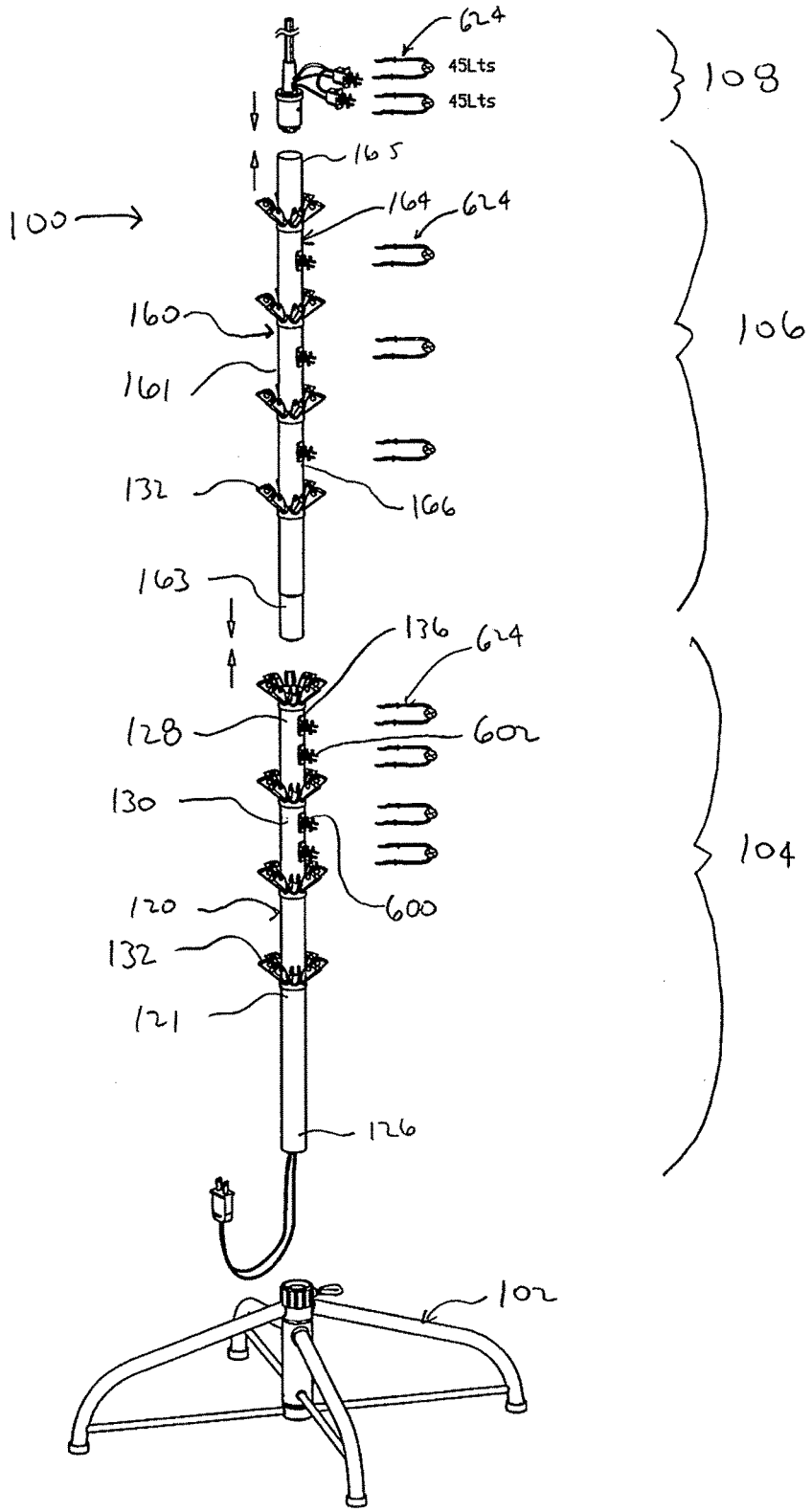
FIG. 43 is an exploded side perspective view of a modular lighted tree in accordance with an embodiment of the invention.

Referring to FIG. 43, another embodiment of tree 100 is depicted. Tree 100 includes base portion 102, first tree portion 104, second tree portion 106, and third tree portion 108.

Tree portion 104 includes first trunk portion 120, trunk body 121 with ends 126 and 128, trunk wall 130, branch rings 132, defining openings 136.

In the depicted embodiment, tree portion 104 also includes a plurality of light strings 624, and a plurality of trunk-string clip 600. Unlike some embodiments described above, in this embodiment, light strings 624 are not integrated into internal wiring harnesses of tree portion 104, but rather, are electrically connected to the wiring harnesses via clips 602 at trunk wall 130.

In an embodiment, tree 100 may include light strings 124, such as a single-wire light string 124, as described above. However, in the embodiment depicted, tree 100 includes lights strings 624 which comprise series-parallel or parallel-series light strings.

Figure 44:
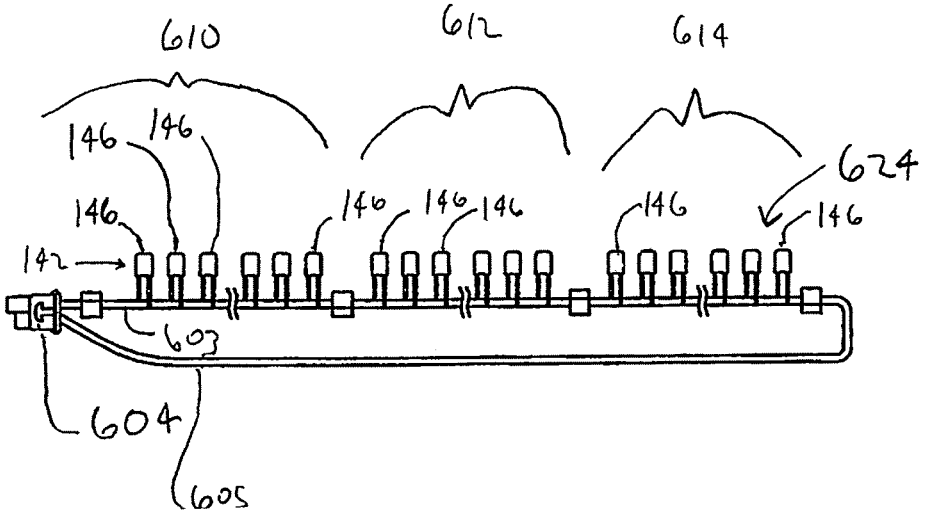
FIG. 44 is a side view of a parallel-series light string in accordance with an embodiment of the invention.

Referring to FIG. 44, an embodiment of parallel-series light string 624 is depicted. In the depicted embodiment, light string 624 includes three sets of light elements 610, set 612, and set 614. Each light element 146 of an individual set is electrically connected in parallel to the other light elements in that set. In other words, all light elements 146 of set 610 are electrically connected to one another in parallel; all light elements 146 of set 612 are electrically connected in parallel to one another; and all light elements 146 of set 614 are electrically connected in parallel to one another.

Further, in the embodiment depicted, sets 610, 612, and 614 are connected in series. In one such embodiment, light string 624 receives 9 VDC power via a string-clip 604. Each light element 146 of each set thusly receives 3 VDC power, in such an embodiment.

In an embodiment, each light set includes fifteen light element assemblies 146, such that light string 624 includes 45 lights. In another embodiment, each set includes ten to twenty-five light element assemblies 146.

Although depicted and described as a parallel-series, DC-powered light string, it will be understood that light string 624 may comprise other configurations as described above with respect to tree 100, and is not limited to the particular embodiment depicted in FIG. 44.

In an embodiment, rather than comprising a standard two-bladed power plug, each light string 624 includes a light-string clip 604 that mates with a corresponding trunk-clip 602 to form trunk-clip 600 (see also FIG. 41). Light-string clip 604 includes a pair of electrical terminals that connect with a pair of electrical terminals of trunk clip 602, thereby making an electrical connection between connectors. In an embodiment, light-string clip 604 may comprise a male connector, while trunk-light connector 602 comprises a female connector.

In an embodiment, clips 602 and 604 comprise a locking connector system. In such an embodiment, when a portion of connector 604 is inserted into a receiving portion of connector 604, the connecters are locked together such that they cannot easily be separated. In the embodiment depicted, projections of light string clip 604 may be pushed in to release or unlock connector 604 from connector 602. Such a locking feature provides an important safety feature for tree 100. When tree portions are assembled together, or when branches are pivoted or otherwise moved around, causing light strings 624 to move, the locking connector system prevents light strings 624 from partially or totally being removed or disconnected from the connector system, trunk, and tree.

Referring again to FIG. 44, tree portion 106 includes second trunk portion 160, trunk body 161 with ends 163 and 165, trunk wall 164, branch rings 132, and a plurality of light strings 624 and trunk-string clips 600.

Figure 45:
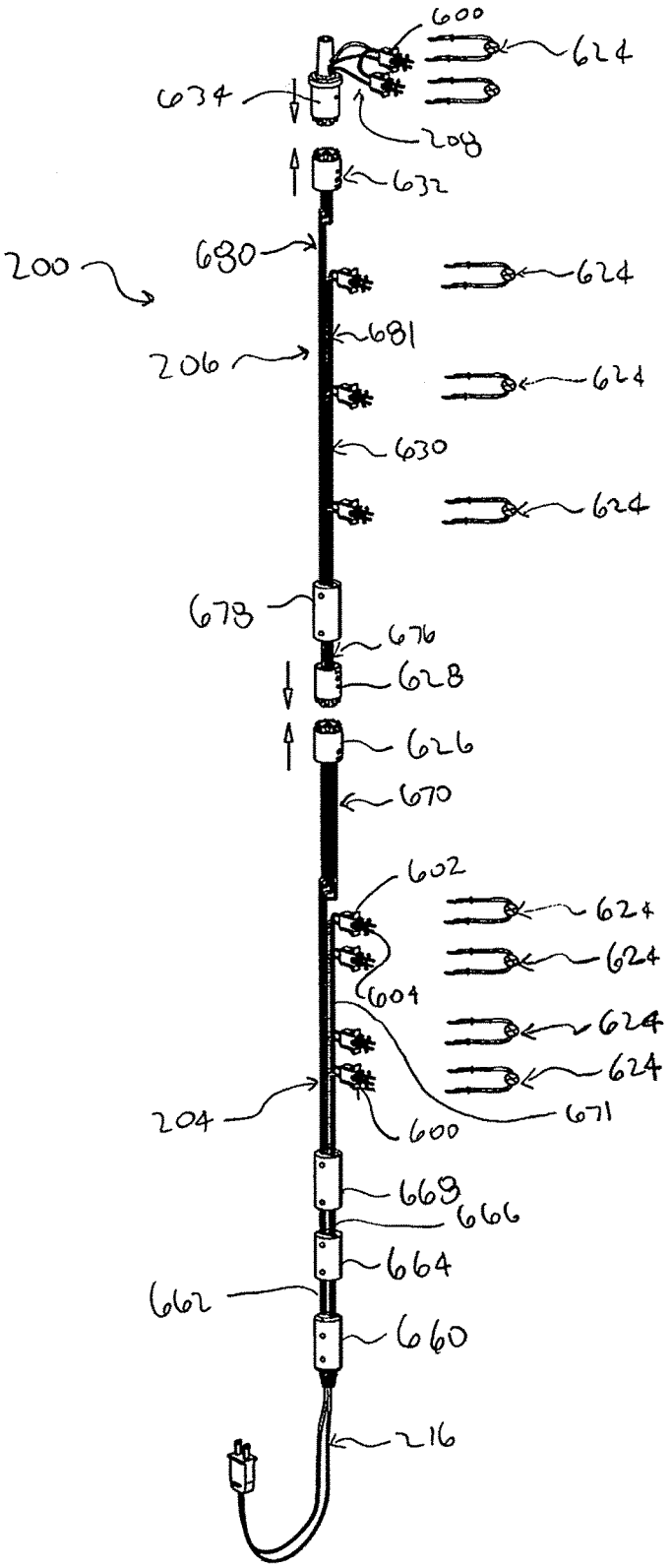
FIG. 45 is a side perspective view of an electrical connection and wiring harness assembly in accordance with an embodiment of the invention.
Figure 48:
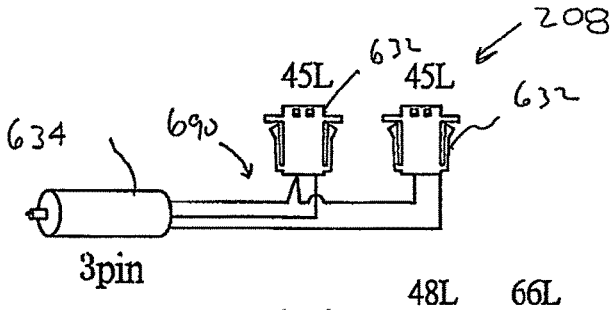
FIG. 48 is a block diagram of an electrical connection and wiring harness subassembly in accordance with an embodiment of the invention.
Figure 47:
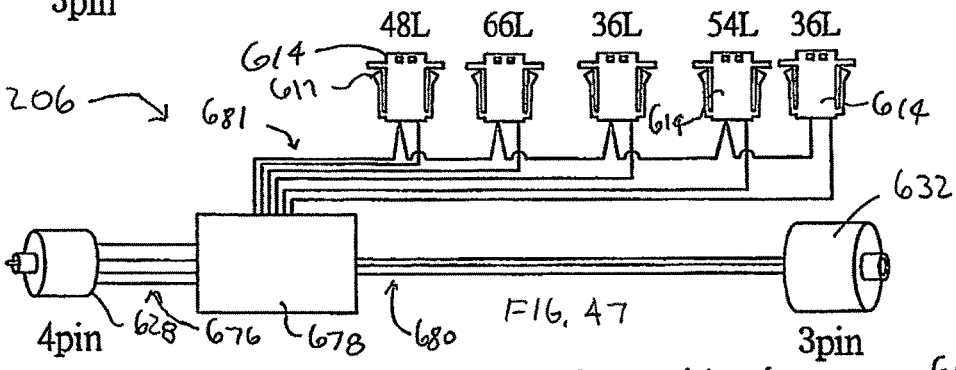
FIG. 47 is a block diagram of an electrical connection and wiring harness subassembly in accordance with an embodiment of the invention.

Referring to FIG. 45, an embodiment of electrical connection and wiring harness assembly 200 includes first electrical connection and wiring harness subassembly 204, second electrical connection and wiring harness subassembly 206, and third electrical connection and wiring harness subassembly 208.

In an embodiment, first wiring harness 204 includes optional transformer 660, power transmission wires 662, main control/distribution hub 664, power transmission wires 666, sub-control/distribution hub 668, power transmission wires 670, light string power wires 671, and trunk electrical hub connector 626. Connector 626 is substantially similar to connector 226 described above, but with some differences described further below. Further details of wiring harness 204 will be depicted and discussed below with reference to FIG. 46.

Still referring to FIG. 45, second wiring harness 206 includes trunk electrical hub connector 628, power transmission wires 676, sub-control/distribution hub 678, power transmission wires 680, light power wires 681, and trunk electrical hub connector 632. In an embodiment, connector 632 is substantially the same as connector 626. Second power-supply wiring harness portion 206 is housed within trunk body 161.

When connected together, power is transmitted through power cord assembly 216, through transformer 660 (when present) and throughout wiring harness portions 204, 206, and 208, supplying lights to all tree portions and light sets 624.

Figure 46:
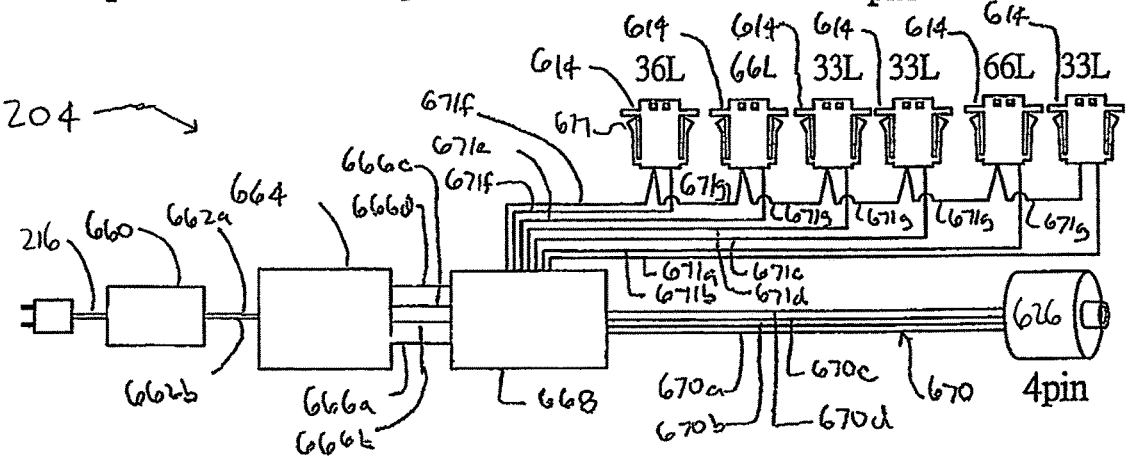
FIG. 46 is a block diagram of an electrical connection and wiring harness subassembly in accordance with an embodiment of the invention.
Figure 49:
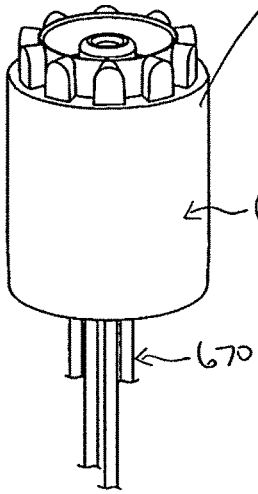
FIG. 49 is a side perspective view of a trunk electrical hub connector connected to inner-trunk wiring in accordance with an embodiment of the invention.
Figure 50:
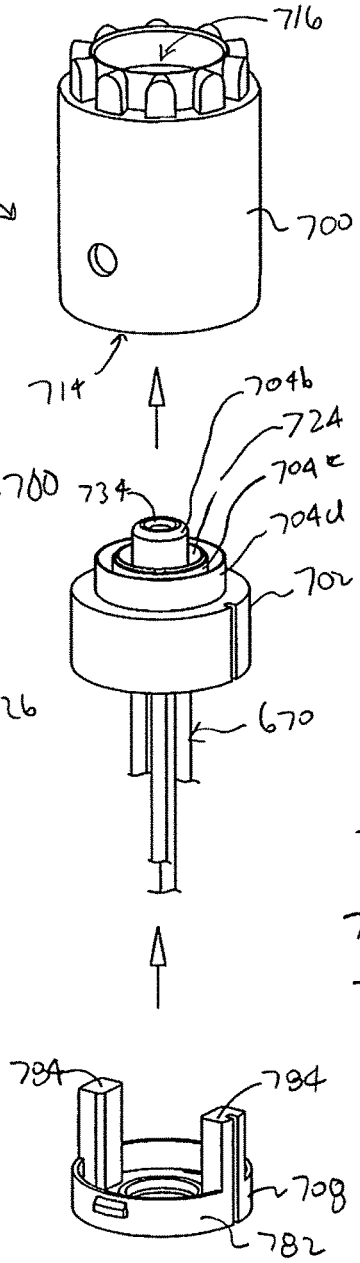
FIG. 50 is a partially exploded perspective view of the trunk electrical hub connector connected to inner-trunk wiring of FIG. 49 in accordance with an embodiment of the invention.

Referring specifically to FIG. 46, power-supply wiring harness portion 204 is depicted in greater detail. Power cord assembly 216 transmits power via two wires to transformer 660. In an embodiment, transformer or adapter 660 transforms an incoming source power to a power suitable for operating light strings 624. When transformer 660 is not used, supply power from an external source powers light strings 624 without conditioning, such as may be the case of with a 120 VAC power source. In embodiments of tree 600 including a transformer 660, the transformer may reduce and condition power, such as transforming an incoming relatively-high voltage alternating-current (AC) power to a relatively low-voltage direct current (DC) power. In an embodiment, a source provides a 110-120 VAC power to transformer 660, which outputs a 9 VDC power. It will be understood that nearly any combination of incoming and outgoing power may be used.

In an embodiment, transformer 660 is cylindrical in shape, and is configured to fit within trunk body 121, or alternatively, to fit within base 102.

Conditioned supply power is transmitted through power transmission wires 662, which in an embodiment, includes power transmission wire 662*a*, having a first polarity, such as a negative or neutral polarity, and a second power transmission wire 662*b* having a second electrical polarity, such as a positive polarity, also referred to as "live" or "hot".

Main control/distribution hub 664 receives supply power as transmitted from power transmission wires 662. In an embodiment, main control/distribution hub 664 simply serves as an electrical connection point, connecting incoming power transmission wires 662 to outgoing power transmission wires 666. In an embodiment, the number of outgoing power transmission wires 666 is greater than the number of incoming power transmission wires 662, for example, two wires in, four wires out. In one such embodiment, as depicted, power transmission wire 662*a* is electrically connected to power transmission wires 666*a* and 666*b*, while power transmission wire 662*b* is electrically connected to power transmission wires 666*c* and 666*d*. In such an embodiment, the conductors of power transmission wires 666 may be smaller in diameter than the conductors of power transmission wires 662. In an alternate embodiment, wire 662*a* is electrically connected to only one power transmission wire 666, such as wire 666*a*, while wire 662*b* is connected to three wires, 666*b*, 666*c*, and 666*d*.

Main control/distribution hub 664 may also include fuses (not depicted) between incoming and outgoing power transmission wires, similar to power hub 222 (see also FIG. 5). In known decorative lighting systems, fuses are generally located within a housing of the power cord assembly.

In addition to serving as a wire distribution hub that doubles, triples, or otherwise increases the number of power transmission wires, main control/distribution hub 664 may also include electronics and electronic circuitry to selectively turn power on and off at each pair of power transmission wires 666*a/c* and 666*b/d*. In such a control embodiment, a switch may be provided, wireless or wired, to turn power on and off. Hub 664 in an embodiment may include a printed-circuit board to facilitate connection between wires. Hub 664 may include a housing having a shape, such as a cylindrical shape, configured to fit within trunk cavity of trunk body 121.

Power transmission wires 666 supply power to sub-control/distribution hub 668. As a distribution hub, hub 668 electrically connects incoming power transmission wires 666 to light string power wires 671.

In an embodiment, hub 668 electrically connects wires 666*a* and 666*c* to power transmission wires 670*a-d*, which in turn transmit power to trunk power supply electrical connector 672. In such an embodiment, wires 666*a* and 666*c* are "doubled" in that two pairs of power-carrying wires 670; in another such embodiment, 666*a* is connected to wire 670*a*, a single neutral wire, and wire 666*b* is connected to wires 670*b, c*, and *d* (positive polarity) such that three pairs of power supply wire configurations are possible. The four wires 666 connect to four pins or terminals of connector assembly 672. Although connector assembly 672 is referred to as a "four-pin" connector to make connection to the four wires of power transmission wires 670, in other embodiments, connector assembly 672 may comprise more or fewer electrical pins or terminals for transmitting power from wiring harness portion 204 to wiring harness portion 206.

Hub 668 also electrically connects power transmission wires 666 to light string power wires 671 as depicted. In the depicted embodiment, wire 671*f* is in electrical connection with the plurality of wires 671*g*. As such; wires 671*f* and 671*g* share a common polarity, generally either neutral or live. Wires 671*a* to 671*e* provide the opposite polarity to each of light strings 624. As such, electrical power is provided to each connector 614, and subsequently to each light string 624.

Further, in this configuration, connector 614 and each corresponding light string 624 may be controlled individually when appropriate control electronics are available within sub-control/distribution hub 668. For example, wires 671*a* to 671*e* may be selectively powered on and off by hub 668 to control power to each light set. In such a configuration, many possible variations of flashing, pulsing and alternatively powering lights strings 624 is possible.

In other embodiments, power transmission wires 666 may comprise more or fewer wires, dependent upon such factors as the number of light strings 624 used with tree portion 604, the degree of individual control of each light string 624, or the degree of control of individual light sets of a string 624. More wires provides generally allows for greater control.

Referring to FIGS. 49-58, an embodiment of trunk electrical hub connector 626 is depicted.

Referring specifically to FIGS. 49-53, trunk electrical hub connector 626 includes housing 700, terminal retainer 702, electrical terminal set 704, and end cap 708.

In an embodiment, housing 700 is substantially similar to housing 300, and defining cavity 714 terminal cavity 716. In an embodiment, terminal cavity 716 may be somewhat larger in diameter than terminal cavity 316 of housing 300.

In an embodiment, terminal retainer 702 comprises a tiered, non-conductive portion that includes bottom portion 710, middle portion 712, and top portion 716.

Bottom portion 710 comprises a generally circular, disc shape, defining slot or keyway 718. Bottom portion 710 defines a diameter small enough to fit inside housing cavity 71.

Middle portion 714 generally comprises a cylindrical shape, and projects outward and upward from bottom portion 710. Middle portion 714 defines a diameter somewhat smaller than a diameter of bottom portion 710. Middle portion 714 defines and outer surface 722, inner surface 724, and cavity 726. Channel 728 is defined by a space between bottom portion 710 and middle portion 712.

Top portion 716 comprises a generally cylindrical shape that extends axially upward and away from middle portion 712. A diameter of top portion 716 is generally smaller than a diameter of middle portion 712. Top portion 716 may define a plurality of retaining or contact ridges 730 distributed about an outer surface 732. Top portion 716 may also include projecting lip 734 having a slightly smaller diameter than a main portion of top portion 716. Top portion 716 defines terminal cavity 736.

In an embodiment, terminal retainer 702 comprises an integral device, while in other embodiments, comprises an assembly of portions 710, 712, and 716.

Figure 54:
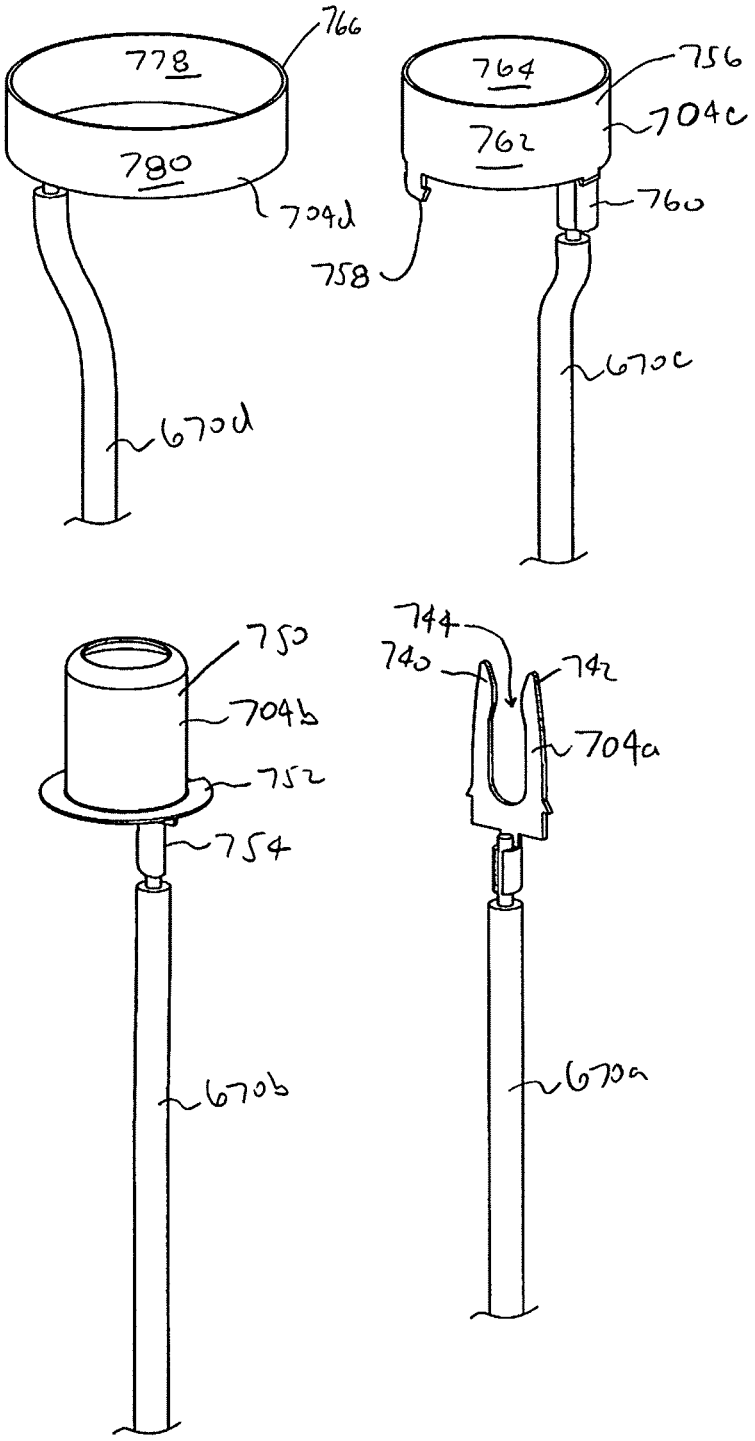
FIG. 54 is a side perspective view of an electrical terminal set, including separated terminals connected to inner-trunk wiring, of the trunk electrical hub connector connected to inner-trunk wiring of FIG. 49 in accordance with an embodiment of the invention.
Figure 58:
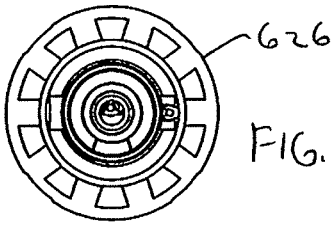
FIG. 58 is a top side view of the trunk electrical hub connector connected to inner-trunk wiring of FIG. 49 in accordance with an embodiment of the invention.

Referring also to FIG. 54, in an embodiment, electrical terminal set 704 includes central terminal 704*a*, second terminal 704*b*, third terminal 704*c*, and fourth terminal 704*d*.

Central terminal 704*a* comprises a flat, fork-like terminal 704 *a* having a first tine 740, second tine 742, and defining terminal receiving space 744. In an embodiment, central terminal 704*a* is crimped, or otherwise electrically connected to power wire 670*a*. Central terminal 704*a* generally comprises a conductive material.

Second terminal 704*b* comprises a cylindrical conductive electrical terminal having cylinder portion 750, base portion 752 and tab 754. In an embodiment, second terminal 704*b* is electrically connected to power wire 670*b* at tab 754.

Third terminal 704*c* comprises a conductive band-like, or ring terminal, which includes band portion 756, locating tab 758, connecting tab 760, outer surface 762, and inner surface 764. In an embodiment, third terminal 740*c* is electrically connected to wire 670*c* at connecting tab 760.

Fourth terminal 704*d* comprises a conductive band-like, or ring terminal having a diameter slight larger than a diameter of third terminal 706*c*. Terminal 704*d* includes band portion 766, defines inside surface 778 and outside surface 780, and is electrically connected to power wire 670*d*.

In the depicted embodiment, and unlike the wires connected to electrical connector 226 that looped in and out of it respective connector, each power wire 760 terminates at electrical connector. Further, in an embodiment, none of terminals 704 is electrically connected at electrical connector 726. This allows for independent control of each wire and connected light strings, if desired. In an alternate embodiment, some electrical terminal 704 may be connected to one another.

Figure 51:
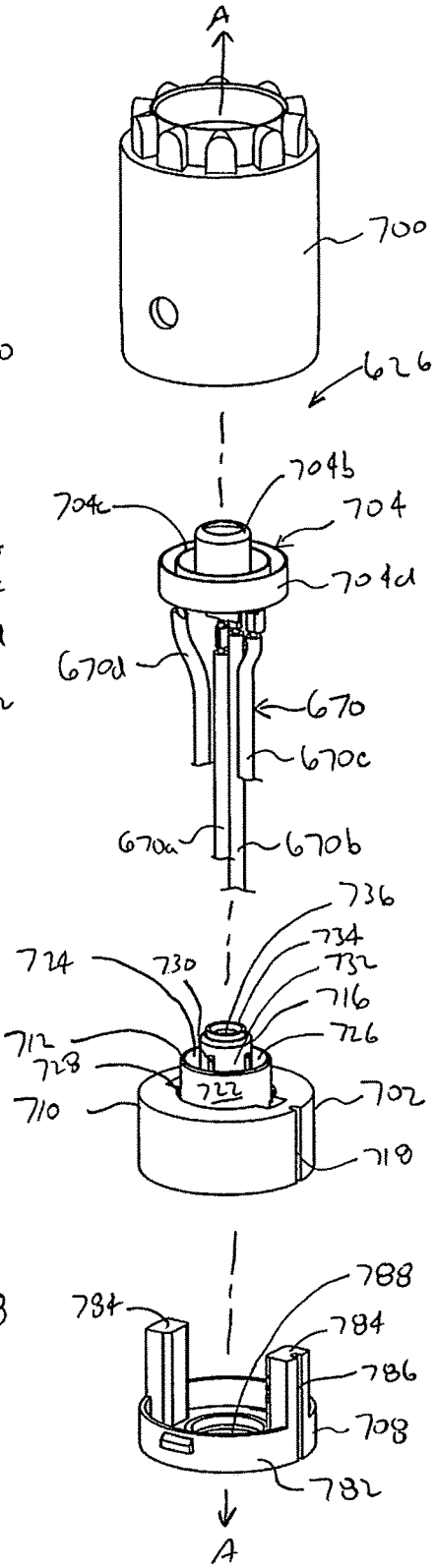
FIG. 51 is an exploded perspective view of the trunk electrical hub connector connected to inner-trunk wiring of FIG. 49 in accordance with an embodiment of the invention.
Figure 52:
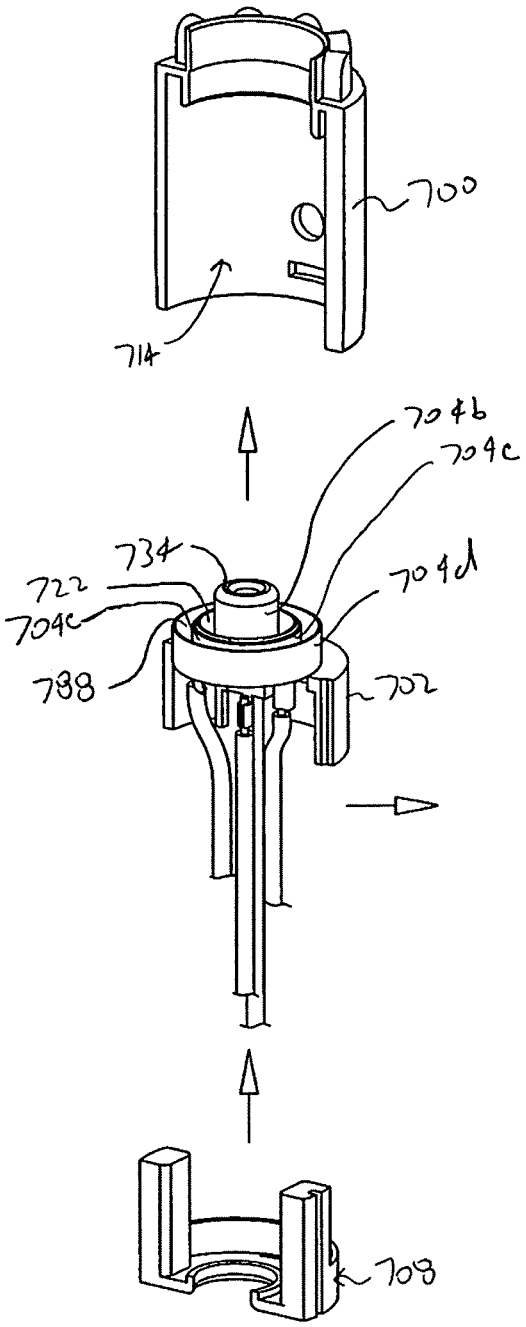
FIG. 52 is a partially exploded partial sectional perspective view of the trunk electrical hub connector connected to inner-trunk wiring of FIG. 49 in accordance with an embodiment of the invention.
Figure 53:
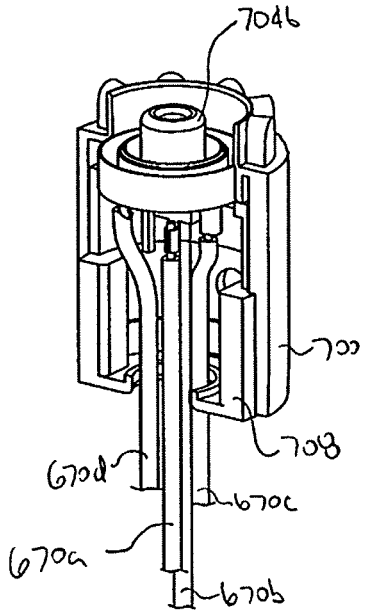
FIG. 53 is a partial sectional side perspective view of the trunk electrical hub connector connected to inner-trunk wiring of FIG. 49 in accordance with an embodiment of the invention.

Referring specifically to FIG. 51, when aligned inside electrical connector 626, terminals 704*a, b, c*, and *d* may be considered coaxial about Axis A. Terminals 704*b, c*, and *d* are generally concentric about one another, and each comprises a circular or ring of conductive material about Axis A.

Retaining cap 708 comprises a general non-conductive material, and includes base portion 782, and posts 784. Posts 784 may define locating slot or keyway 786. Cap 708 also defines wire aperture 788.

Referring to FIGS. 49-53 when terminal set 704 is assembled onto terminal retainer 702: fourth terminal 704*d* rests on bottom portion 710; a portion of third terminal 703*c* resides in channel 728 and is adjacent middle portion 722 of terminal retainer 702 such that inside surface 764 is adjacent outside surface 722; second terminal 704*b* is placed over top portion 716 adjacent ridges 730, with lip 734 even with a top of terminal 740*b*, or just above; central terminal 704*a* is located in cavity 736.

When further assembled, retainer 702 with terminal set 704 is inserted into terminal cavity 714 of housing 700 and held inside cap 708. Wires 670 extend axially and downwardly through wire aperture 788.

In an embodiment, terminal 704*b* does not extend outside of terminal receiving cavity 716.

Referring to FIGS. 59-68, an embodiment of trunk electrical connector 628 is depicted.

In an embodiment, trunk electrical connector 628 includes housing 800, terminal retainer 802, electrical terminal set 804 connected to wires 676.

Housing 800 is substantially similar to housing 400, with at least the exception of terminal post slots 802, including 802*a* and 802*b*. Housing 800 includes wall 815 which define terminal post slots 802*a* and 802*b*. Housing 800 defines terminal receiving cavity 816 and terminal retainer cavity 814.

Terminal retainer 802, in an embodiment, includes disc-shaped base portion 820, terminal-support posts 822*a* and 822*b*, and generally cylindrical top portion 824. Top portion 824 defines central terminal receiving aperture 826; each post 822*a* and 822*b* define terminal receiving slots 828*a* and 828*b*, respectively; and channel 830 is formed between base portion 820 and top portion 824. Terminal 802 generally comprises a non-conductive material, and may be a single piece, integrated structure, or an assembly.

Figure 62:
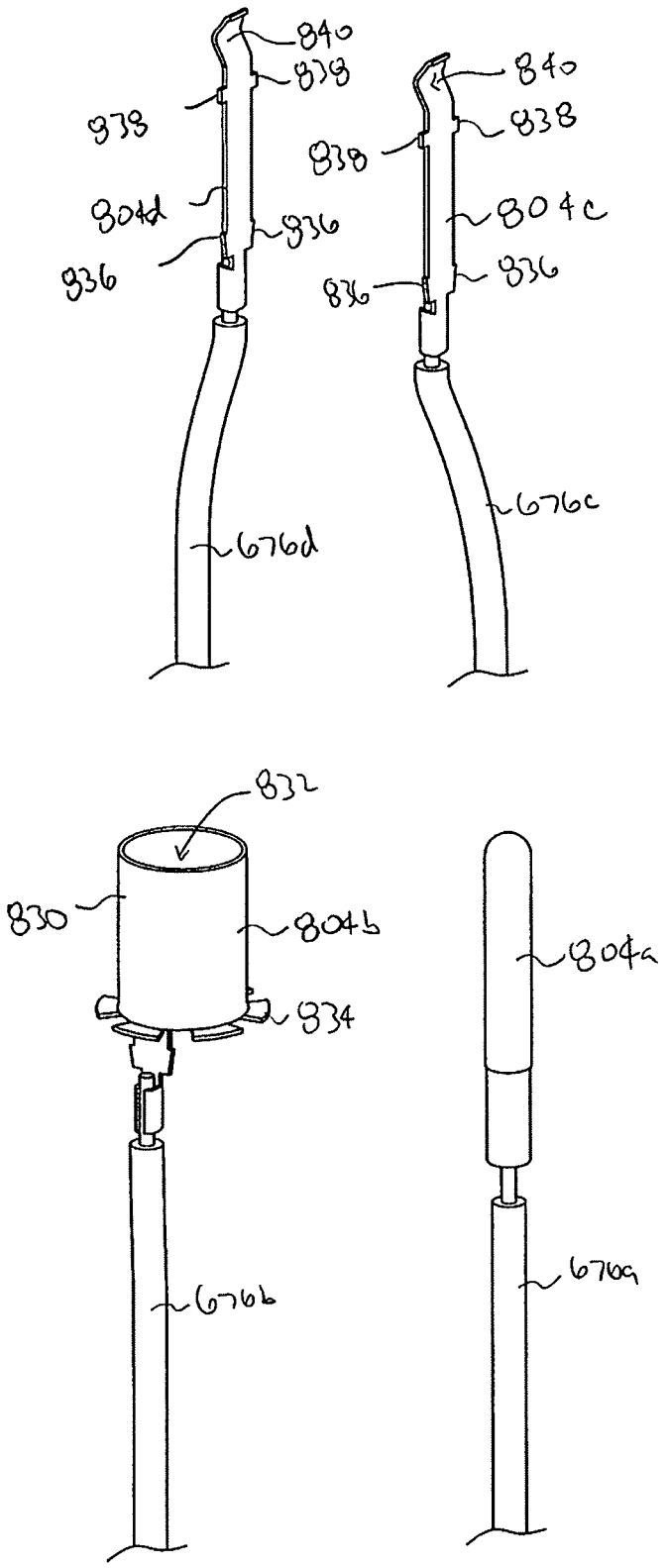
FIG. 62 is a side perspective view of an electrical terminal set, including separated terminals connected to inner-trunk wiring, of the trunk electrical hub connector connected to inner-trunk wiring of FIG. 59 in accordance with an embodiment of the invention.
Figure 63:
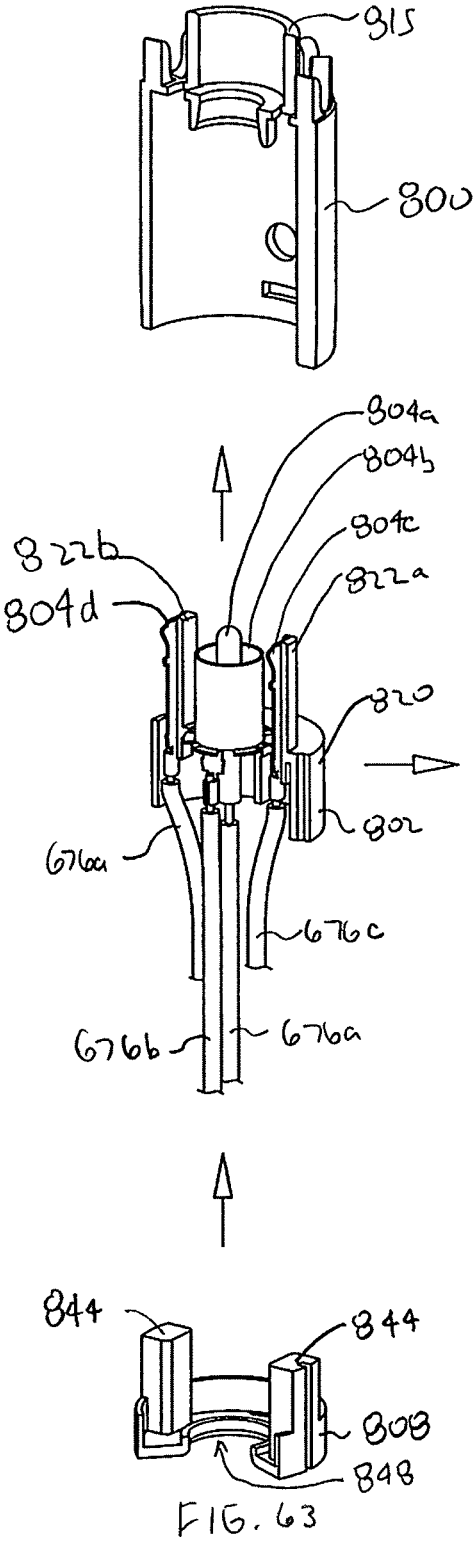
FIG. 63 is a partially exploded partial sectional perspective view of the trunk electrical hub connector connected to inner-trunk wiring of FIG. 59 in accordance with an embodiment of the invention.
Figure 64:
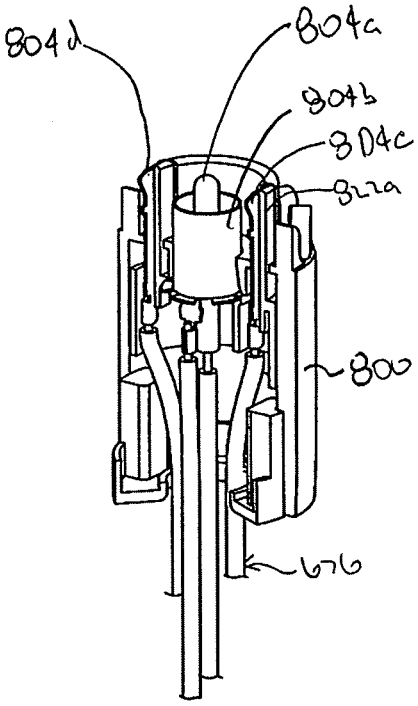
FIG. 64 is a partial sectional side perspective view of the trunk electrical hub connector connected to inner-trunk wiring of FIG. 59 in accordance with an embodiment of the invention.
Figure 68:
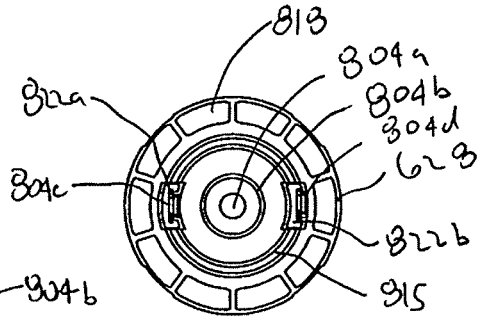
FIG. 68 is a top side view of the trunk electrical hub connector connected to inner-trunk wiring of FIG. 59 in accordance with an embodiment of the invention.

Referring also to FIG. 62, terminals 804 with wires 676 are depicted.

In an embodiment, electrical terminal 804*a* comprises a pin terminal made of conductive material. Terminal 804*a* is electrically connected to power wire 676*a*.

In an embodiment, electrical terminal 804*b* comprises a conductive cylindrical terminal having band portion 830 defining cavity 832 and support base 834. In an embodiment, support base 834 comprises a series of flanges or tabs distributed about a circumference of base 834 and extending transversely away from a bottom portion of base 834. Terminal 804*b* is electrically connected to power wire 676*b*, which includes an insulator portion and a conductor portion, as do all wires described herein.

In an embodiment, electrical terminals 804*c* and 804*d* each comprise a generally long, flat shape defining lower locking tabs 836, upper locking tabs 838. Terminals 804*c* may also each include spring portion 840 that defines a bend near an end of terminal 804*c* such that terminal 804*c* can serve as a spring when secured in terminal retainer 802. Electrical terminals 804*c* and 804*d* are electrically connected to power wires 7=676*c* and 676*d*, respectively.

In an embodiment, end cap 908 comprises a non-conductive material and includes base portion 842, posts 844, retaining clips 846, and defines wire aperture 848. Base portion 842 defines an annular ring, while posts 844 extend upwardly and away from base portion 842.

Referring specifically to FIGS. 63-68, when assembled, terminals 804 are coupled to terminal retainer 802; terminal retainer 802 with terminals 804 is inserted into housing 800; and cap 808 is inserted into a lower portion of housing 800 with posts 844 extending inward, while wires 676 extend through wire aperture 848.

Terminal 804*a* is inserted through terminal receiving aperture 826; terminal 804*b* receives top portion 824; terminal 804*c* is received by slot 828*a* and is adjacent to, and supported by, terminal-support post 822*a*; and terminal 804*d* is received by slot 828*b* and is adjacent to, and supported by, terminal-support post 822*b*. In an embodiment, terminal 804*c* confronts terminal 804*b*, and is generally inward or center facing, while terminal 804*d* is generally outward facing, and exposed at a perimeter of connector 828. As such, the positioning of terminals 804*c* and 804 is asymmetrical about a center axis, while terminals 804*a* and 804*b* are concentric about a center axis. Such a distribution of terminals separates the terminals from one another to provide space for complementary portions of connector 826 to be received, and to maximize distance and structure between terminals to reduce the possibility of arcing and/or shorting.

Terminal retainer 802 inserted into housing 800 causes terminal support posts 822*a* and 822*b* to be inserted into slots 822*a* and 822*c*, thereby "completing" wall 815, or filling in the gaps of wall 815 caused by slots 822. Assembling all electric terminals 804 onto terminal retainer 802, then inserting the retainer/terminal assembly into housing 800 reduces manufacturing time.

Cap 808 snaps into a bottom portion of housing 800, and retains terminal retainer 802 in cavity 814 of housing 800.

Figure 55:
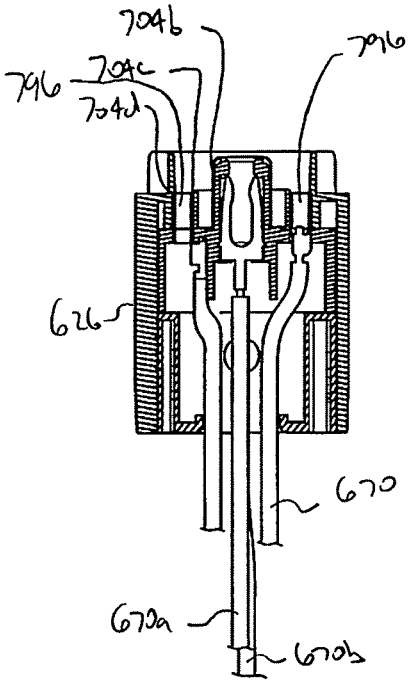
FIG. 55 is a side sectional view of the trunk electrical hub connector connected to inner-trunk wiring of FIG. 49 in accordance with an embodiment of the invention.
Figure 56:
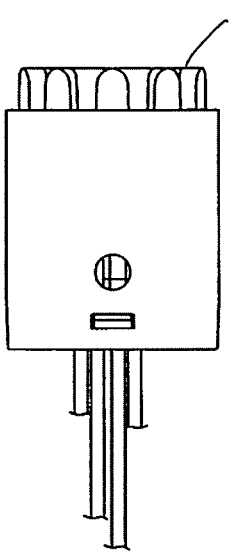
FIG. 56 is a front side view of the trunk electrical hub connector connected to inner-trunk wiring of FIG. 49 in accordance with an embodiment of the invention.
Figure 57:
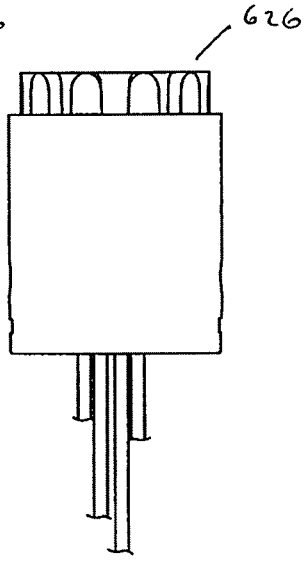
FIG. 57 is a right side view of the trunk electrical hub connector connected to inner-trunk wiring of FIG. 49 in accordance with an embodiment of the invention.
Figure 59:
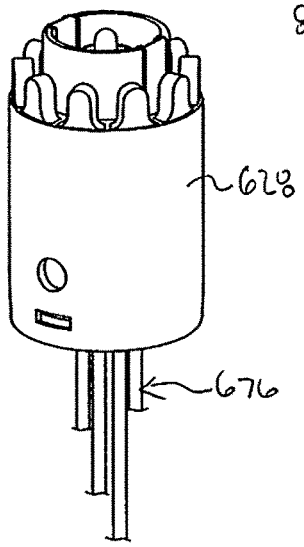
FIG. 59 is a side perspective view of a trunk electrical hub connector connected to inner-trunk wiring in accordance with an embodiment of the invention.
Figure 60:
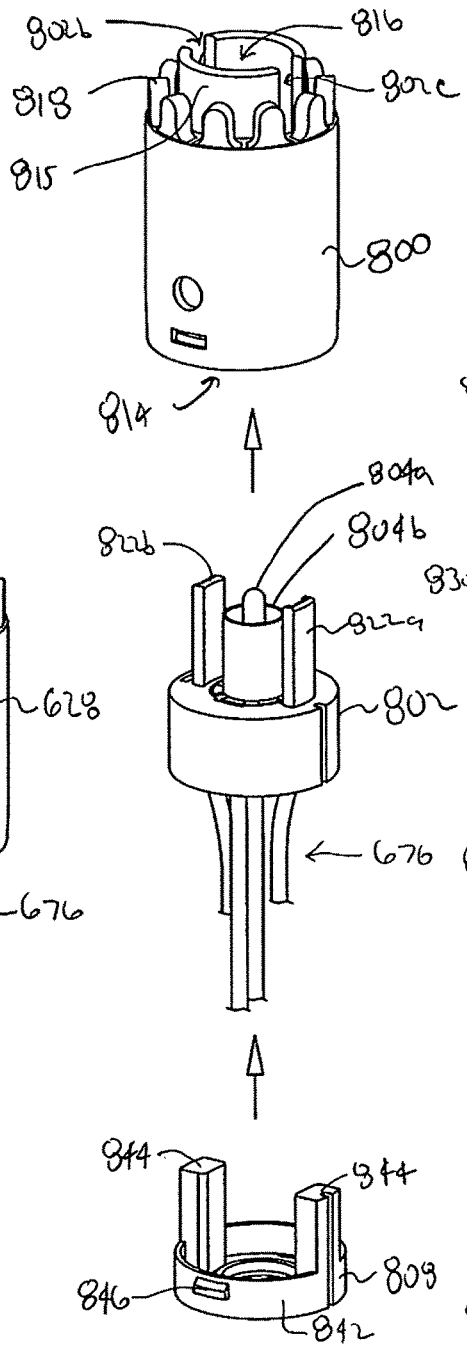
FIG. 60 is a partially exploded perspective view of the trunk electrical hub connector connected to inner-trunk wiring of FIG. 59 in accordance with an embodiment of the invention.
Figure 61:
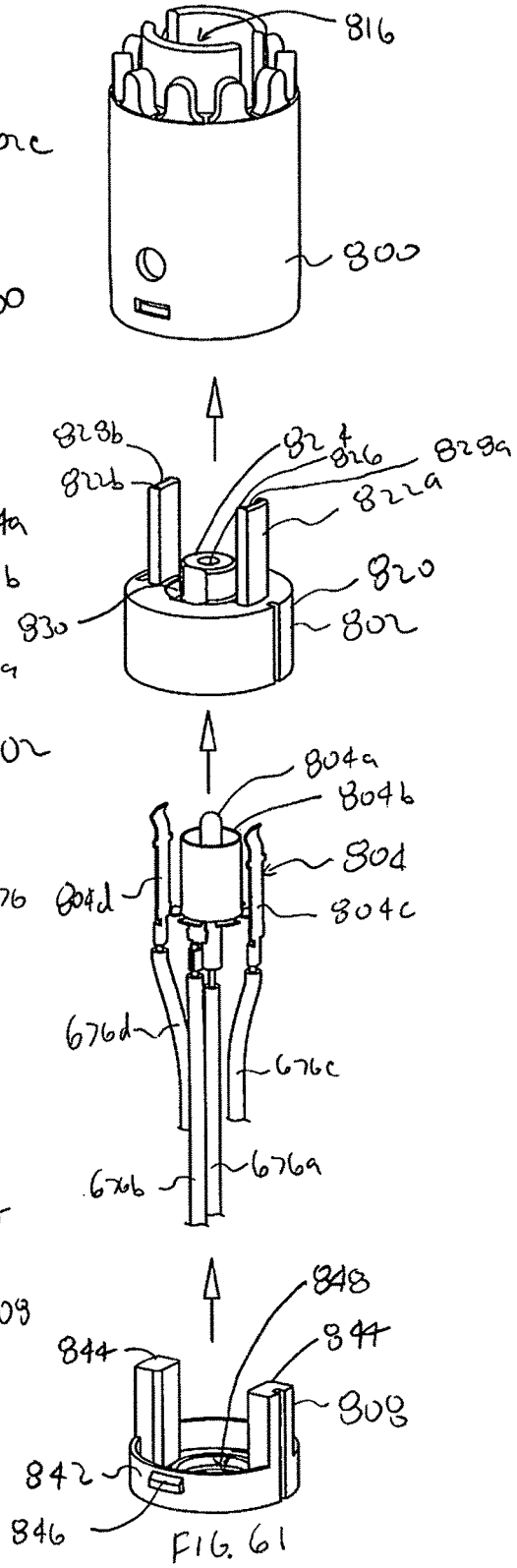
FIG. 61 is an exploded perspective view of the trunk electrical hub connector connected to inner-trunk wiring of FIG. 58 in accordance with an embodiment of the invention.
Figure 65:
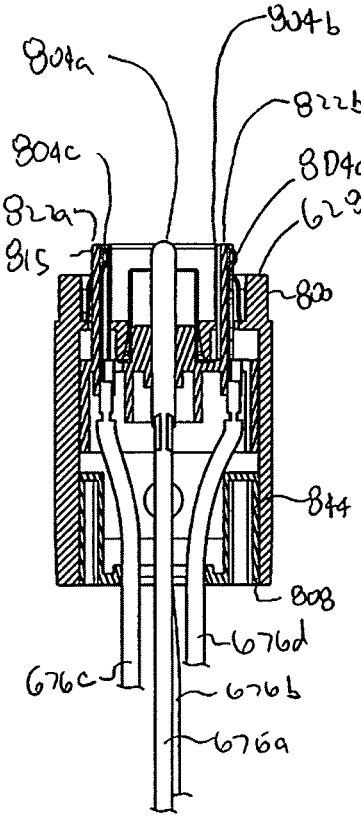
FIG. 65 is a side sectional view of the trunk electrical hub connector connected to inner-trunk wiring of FIG. 59 in accordance with an embodiment of the invention.
Figure 66:
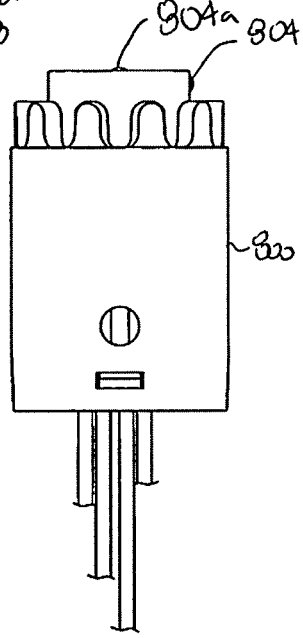
FIG. 66 is a front side view of the trunk electrical hub connector connected to inner-trunk wiring of FIG. 59 in accordance with an embodiment of the invention.
Figure 67:
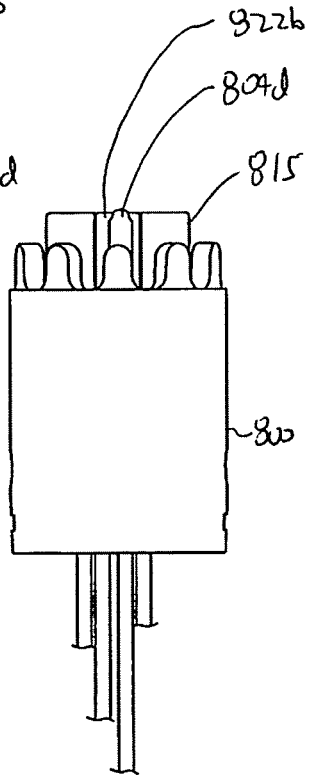
FIG. 67 is a right side view of the trunk electrical hub connector connected to inner-trunk wiring of FIG. 59 in accordance with an embodiment of the invention.

Referring to FIGS. 55 and 65, when trunk electrical connectors 826 and 828 are coupled together: terminal 804*a* is received by cavity 744 of terminal 704*a*, thereby making an electrical connection between terminals 804*a* and 704*a* and their respective power wires 676*a* and 670*a*; and terminal 804*b* fits over terminal 704*b*, such that an outside surface of terminal 704*b* is in contact with an inside surface of terminal 804*b*, thereby making an electrical connection between terminals 804*b* and 704*b*, and their respective power wires 676*b* and 670*b*.

A portion of wall 815 and portions of terminal support posts 822*a* and 822*b*, and their respective terminals 804*c* and 804*d*, fit into the annular ring cavity 796 formed between terminals 704*c* and 704*d*. Terminal 804*c* confronts and contacts terminal 704*c*, while terminal 804*d* confronts and contacts terminal 704*d*. Consequently, terminal 804*c* is in electrical connection with terminal 704*c* such that wires 676*c* and 670*c* are in electrical connection; terminal 804*d* is in electrical connection with terminal 704*d* such that power wires 676*d* and 670*d* are also in electrical connection.

Consequently, trunk electrical connectors 826 and 828 couple together to form a mechanical and an electrical connection. Further, terminal sets 704 and 804 are configured such that they may be joined in any rotational alignment or orientation about a central axis. Housings 700 and 800, when the rotation-lock features, such as projections 718 and 818 in an embodiment, are present, cause connectors 826 and 828 to be able to be joined in a limited number of rotational alignments, ten alignments in the embodiment depicted. In some embodiments, the number of rotational alignments ranges from three to twenty.

In an embodiment without rotation-lock features, trunk electrical connectors 826 and 828 may be coupled in any rotational alignment about a central axis, such as Axis A of FIG. 1, such that tree portions may also be aligned in any rotational alignment.

It will be understood that electrical connectors 232 and 234 may be substantially the same as connectors 226 and 228, and couple in the same manner.

Figure 69:
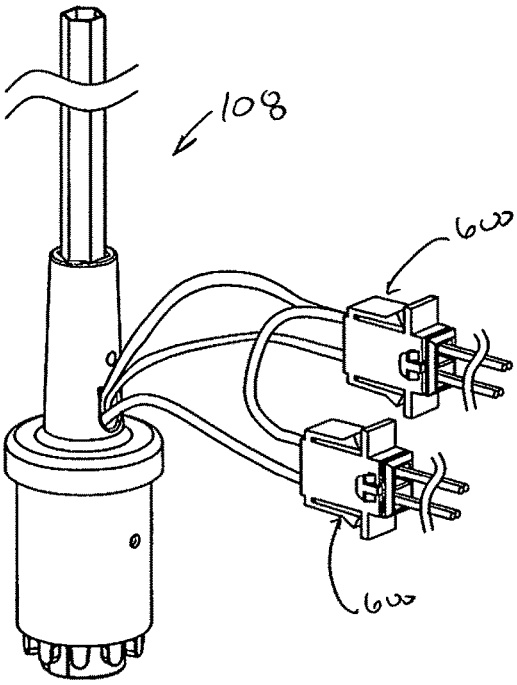
FIG. 69 is a side perspective view of a lighted tree portion of the modular lighted tree of FIG. 43 in accordance with an embodiment of the invention.
Figure 70:
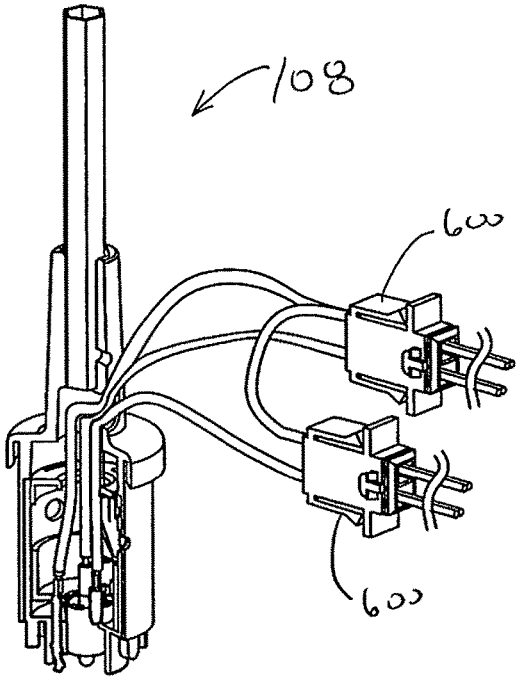
FIG. 70 is a partial sectional side perspective view of the lighted tree portion of FIG. 69 in accordance with an embodiment of the invention.

Referring to FIGS. 69 and 70, an embodiment of tree portion 108, minus branches, and with trunk-string clips 600, is depicted.

Figure 71:
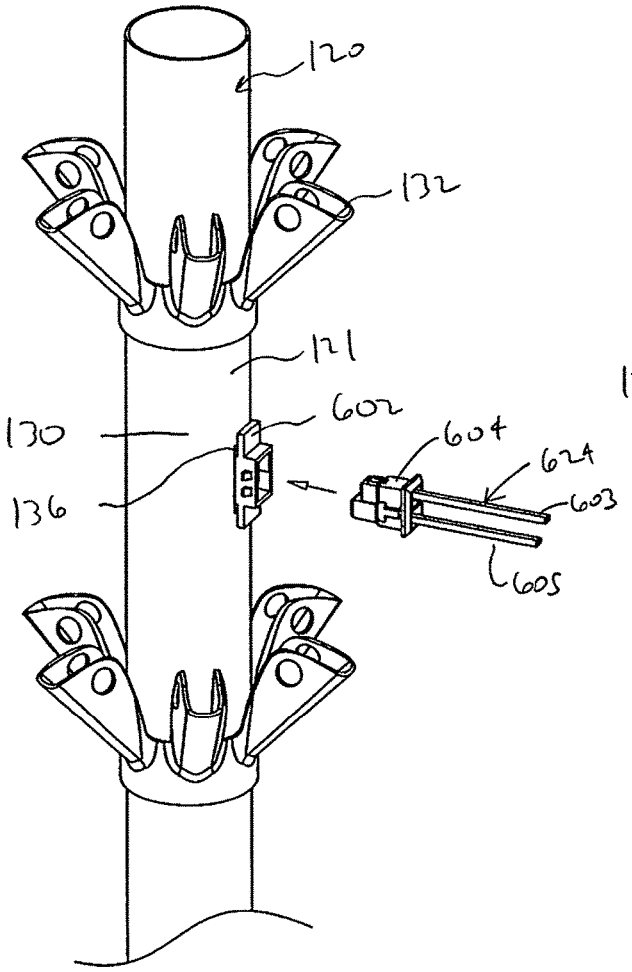
FIGS. 71-72 are side perspective views showing a connection between a tree portion and a light string of the modular lighted tree of FIG. 43 in accordance with an embodiment of the invention.
Figure 72:
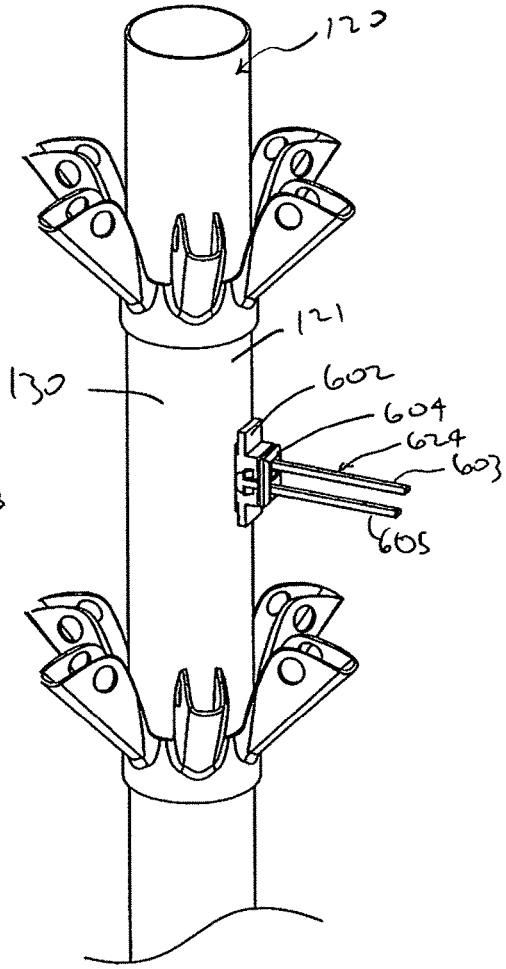

Referring to FIGS. 71 and 72, an embodiment of tree portion 120 depicting connection of a light string 624 via trunk-string clip 600 is depicted. In an embodiment, trunk clip 602 is inserted into aperture 136 of trunk wall 130 and secured to trunk wall 130. Trunk clip 602 is in electrical connection with wire harness 204 as described above.

Light-string clip 604 is mechanically and electrically connected to light string 624, including connected to first/lead wire pair 603 and last/return wire pair 605 (see also FIGS. 43 and 45).

Light-string clip 604 is inserted into trunk clip 602, thereby securing light string 624 to trunk portion 120, and electrically connecting light string 624 to wiring harness 204, such that power may be provided to light string 624 when tree 100 receives power from an external power source.

Figure 73:
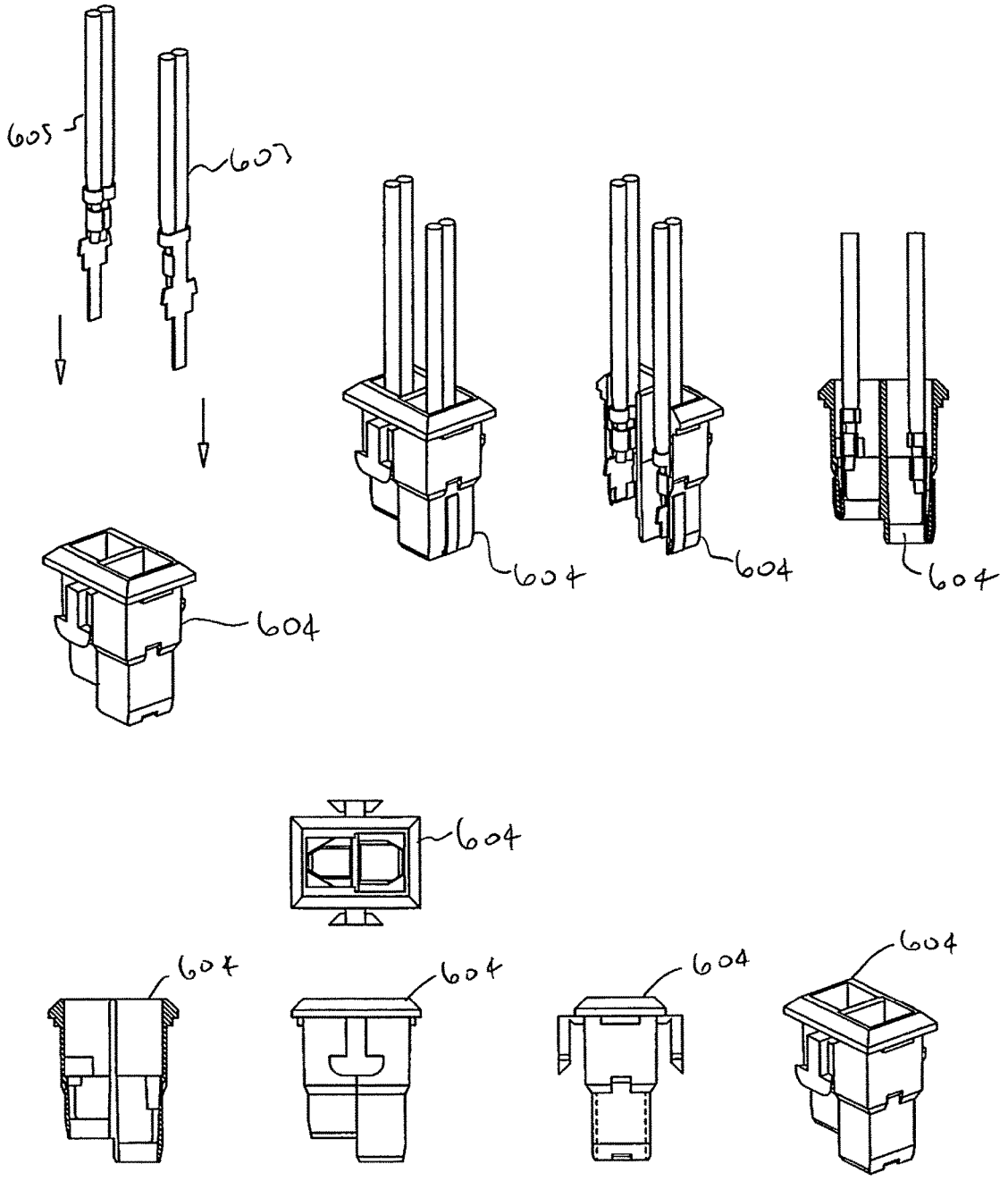
FIG. 73 shows, in the top row from left to right, an exploded side perspective view of a light string clip with wiring; a side perspective view of the light string clip with wiring; a sectional side perspective view of the light string clip with wiring; and a sectional front side view of the light string clip with wiring; in the middle row, a top side view of the light string clip; and, in the bottom row from left to right, a sectional front side view of the light string clip; a front side view of the light string clip; a right side view of the light string clip with phantom lines; and a side perspective view of the light string clip in accordance with an embodiment of the invention.

FIG. 73 provides additional views of light string clip 604 with wires 603.

Figure 74:
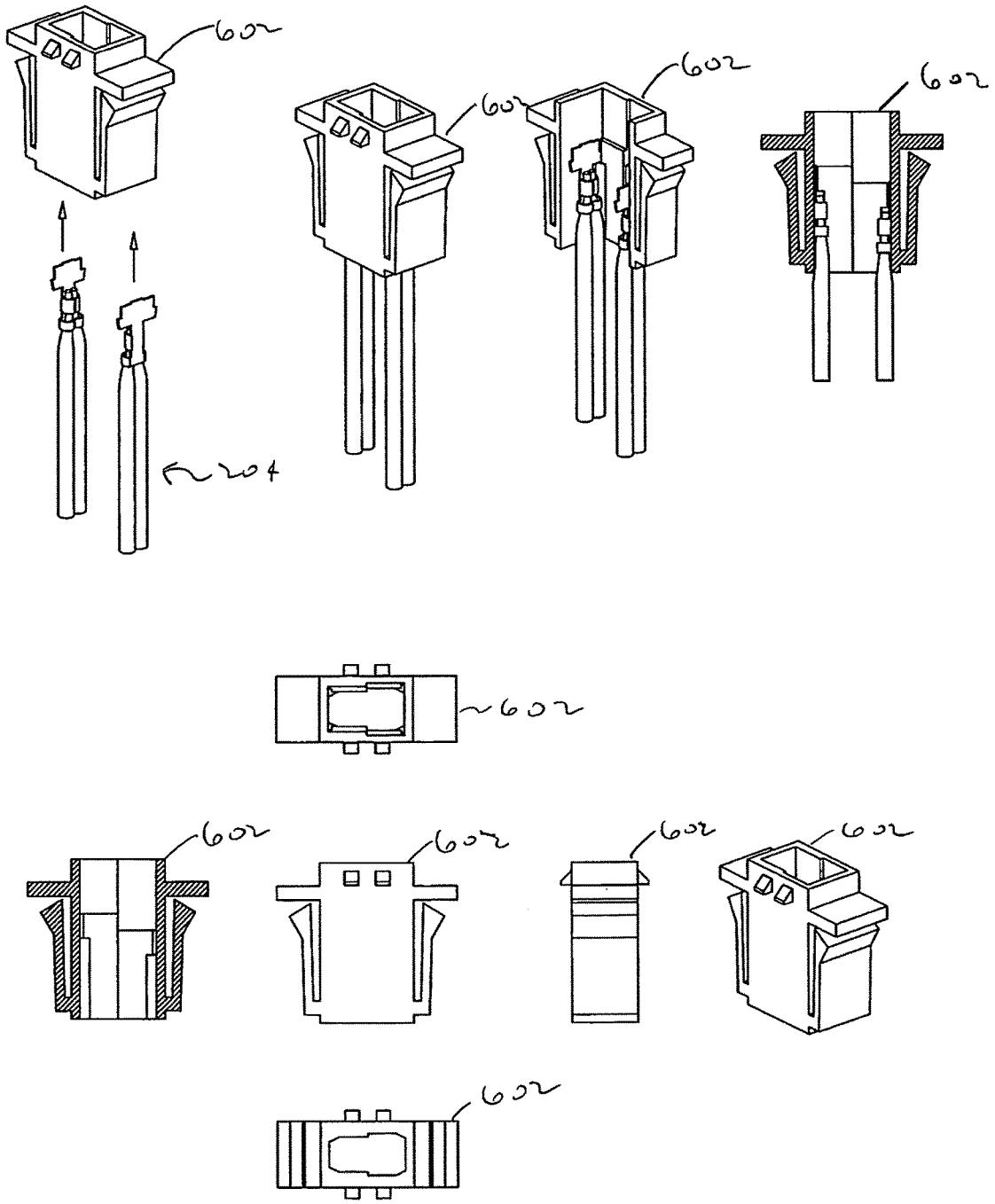
FIG. 74 shows, in the top row from left to right, an exploded side perspective view of a trunk clip connected to a wire harness; a side perspective view of the trunk clip connected to the wire harness; a sectional side perspective view of the trunk clip connected to the wire harness; and a sectional front side view of the trunk clip connected to the wire harness; in the second row, a top side view of the trunk clip; in the third row from left to right, a sectional front side view of the trunk clip; a front side view of the trunk clip; a right side view of the trunk clip; and a side perspective view of the trunk clip; and, in the bottom row, a bottom side view of the trunk clip in accordance with an embodiment of the invention.

FIG. 74 provides additional views of trunk clip 602 connected to wire harness 204.

Figure 75:
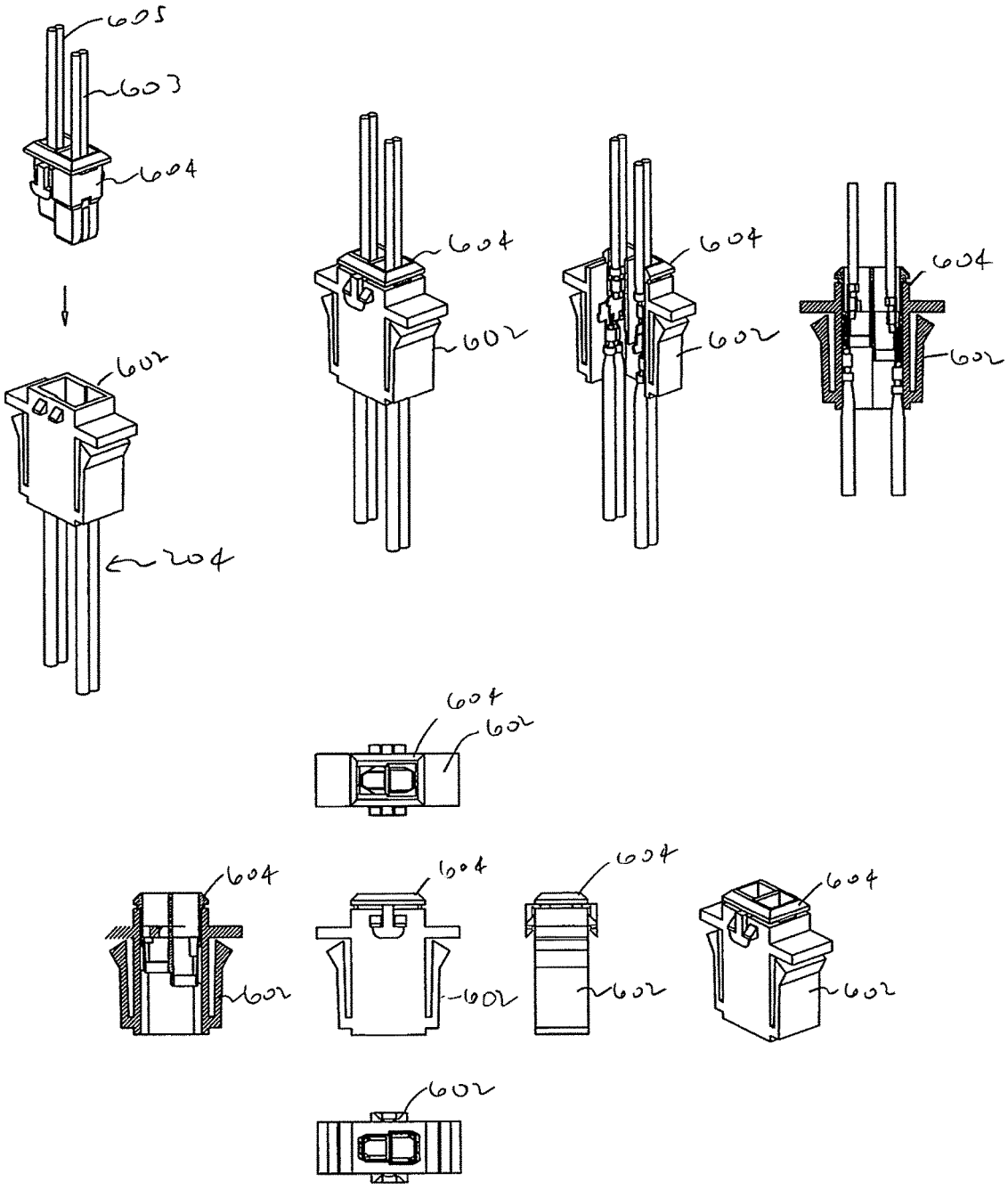
FIG. 75 shows, in the top row from left to right, an exploded side perspective view of a light string clip connected to a trunk clip with wiring; a side perspective view of the light string clip connected to the trunk clip with wiring; a sectional side perspective view of the light string clip connected to the trunk clip with wiring; and a sectional front side view of the light string clip connected to the trunk clip with wiring; in the second row, a top side view of the light string clip connected to the trunk clip; in the third row from left to right, a sectional front side view of the light string clip connected to the trunk clip; a front side view of the light string clip connected to the trunk clip; a right side view of the light string clip connected to the trunk clip; and a side perspective view of the light string clip connected to the trunk clip; and, in the bottom row, a bottom side view of the light string clip connected to the trunk clip in accordance with an embodiment of the invention.

FIG. 75 provides additional views of light-string clip 604 connected to trunk clip 602.

The various embodiments of tree trunk electrical hub connectors and systems as described and depicted above provide a number of features to enhance the assembly, safety, and operation of modern, multi-sectional artificial trees, including modular lighted trees of the claimed invention.

The embodiments above are intended to be illustrative and not limiting. Additional embodiments are within the claims. In addition, although aspects of the present invention have been described with reference to particular embodiments, those skilled in the art will recognize that changes can be made in form and detail without departing from the spirit and scope of the invention, as defined by the claims.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed:

1. A multi-terminal, rotation-locking, lighted artificial tree, comprising:

a first tree portion including a first trunk portion defining a lengthwise axis, first power transmission wires and a first trunk electrical connector, the first trunk electrical connector being coupled to the first trunk portion and comprising a first connector housing portion and a first electrical terminal set, the first connector housing portion supporting the first electrical terminal set, the first electrical terminal set in electrical connection with the first transmission wires and including a first electrical terminal, a second electrical terminal, a third electrical terminal, and a fourth electrical terminal, wherein the first trunk housing includes a plurality of axially-extending projections and an axially-extending cylindrical portion supporting at least two electrical terminals of the first electrical terminal set; and a second tree portion connectable to the first tree portion, the second tree portion including a second trunk portion, second power transmission wires and a second trunk electrical connector, the second trunk electrical connector being coupled to the second trunk portion and comprising a second connector housing portion and a second electrical terminal set, the second connector housing portion supporting the second electrical terminal set, the second electrical terminal set in electrical connection with the second transmission wires and including a first electrical terminal, a second electrical terminal, a third electrical terminal, and a fourth electrical terminal, wherein the second trunk housing includes a plurality of recesses configured to receive the plurality of axial-extending projections;

wherein upon connection of the first tree portion to the second tree portion, the first trunk electrical connector engages the second trunk electrical connector, the plurality of axially-extending projections are received by the plurality of recesses to prevent rotation about the axis of the first tree portion with the second tree portion, and the first electrical terminal set makes electrical connection with the second electrical terminal set.

2. The artificial tree of claim 1, wherein the axially-extending, cylindrical portion defines an inside surface and an outside surface, the third electrical terminal of the first electrical terminal set being adjacent the inside surface, and the fourth electrical terminal of the first electrical terminal set being adjacent the outside surface, such that a portion of the cylindrical portion is between the third electrical terminal of the first electrical terminal set and the fourth electrical terminal of the first electrical terminal set.

3. The artificial tree of claim 1, wherein the first housing portion defines a space between the axially-extending projections and the axially-extending cylindrical portion.

4. The artificial tree of claim 1, wherein the second housing portion includes a plurality of axially-extending projections and the first housing defines a plurality of recesses configured to receive the plurality of axially-extending projections of the second housing.

5. The artificial tree of claim 1, wherein each of the first, second, third, and fourth electrical terminals of the second electrical terminal set comprise cylindrical electrical terminals.

6. The artificial tree of claim 1, wherein the first electrical terminal set includes a pin-like terminal, a cylindrical terminal, and two generally rectangular terminals.

7. The artificial tree of claim 1, further comprising a first light string including a plurality of light elements, light string wires, and a light string clip, the light string clip including a locking mechanism for attachment to a trunk clip, the trunk clip being attached to the first trunk portion.

8. The artificial tree of claim 7, wherein the locking mechanism comprises a releasable locking mechanism.

9. The artificial tree of claim 7, wherein the locking mechanism comprises a portion of the light string clip projecting outwardly and away from an outside surface of the light string clip and configured to be received by the trunk clip.

10. The multi-terminal, rotation-locking, lighted artificial tree, of claim 1, further comprising a first set of light elements and a second set of light elements, the first set of light elements powered independently of the second set of light elements.

11. The rotation-locking, lighted artificial tree, of claim 10, wherein the first electrical terminal and the second electrical terminal of the first electrical terminal set, and the first electrical terminal and the second electrical terminal of the second electrical terminal set, are configured to provide power to the first set of light elements, and the third electrical terminal and the fourth electrical terminal of the first electrical terminal set, and the third electrical terminal and the fourth electrical terminal of the second electrical terminal set, are configured to provide power to the second set of light elements.

12. The rotation-locking, lighted artificial tree of claim 10, further comprising a control device for causing one or both of the first and second sets of light elements to be powered.

13. The rotation-locking, lighted artificial tree of claim 1, the first electrical terminal and the second electrical terminal of the first electrical terminal set, and the first electrical terminal and the second electrical terminal of the second electrical terminal set, comprise a portion of a first independent electrical circuit, and the third electrical terminal and the fourth electrical terminal of the first electrical terminal set, and the third electrical terminal and the fourth electrical terminal of the second electrical terminal set, comprise a portion of a second independent electrical circuit.

14. An electrical transmission and connection system for a lighted artificial tree, comprising:

a power cord configured to receive power from an outside source of power;

a first trunk electrical connector comprising a first substantially non-conductive housing portion coupled to a first plurality of conductive electrical terminals, the first housing portion including a plurality of projections extending from a surface of the first substantially non-conductive housing portion;

a second trunk electrical connector comprising a second substantially non-conductive housing portion coupled to a second plurality of conductive electrical terminals, the second housing portion including a plurality of recesses configured to receive the plurality of projections of the first substantially non-conductive housing portion;

a third trunk electrical connector in electrical connection with the second trunk electrical connector;

a first plurality of power transmission wires in electrical connection with the power cord and the first trunk electrical connector, and a second plurality of power transmission wires in electrical connection with the second electrical connector and the third trunk electrical connector, and; a tree trunk portion, wherein the third trunk electrical connector and one of the first or the second trunk electrical connectors are both located in the tree trunk portion.

15. The system of claim 14, further comprising a trunk clip in electrical connection with the plurality of power transmission wires and having a pair of conductive electrical terminals.

16. The system of claim 15, further comprising a light string clip having a pair of conductive electrical terminals, and having a male portion sized and dimensioned to be received by an opening of the trunk clip.

17. The system of claim 16, further comprising a set of light string wires and a set of light elements in electrical connection with the conductive electrical terminals of the light string clip.

18. The lighted artificial tree of claim 15, wherein a portion of the trunk clip is located within an interior of a trunk of the tree, and another portion of the trunk clip extends outside of the interior.

19. A lighted artificial tree, comprising the electrical transmission and connection system of claim 14.

20. The lighted artificial tree of claim 19, wherein the power transmission wires are located in a cavity of a trunk of the tree.

21. The electrical transmission and connection system of claim 14, wherein each of the first, second and the third trunk electrical connectors include a first electrical terminal, a second electrical terminal, a third electrical terminal, and a fourth electrical terminal.

22. The electrical transmission and connection system of claim 21, wherein the first electrical terminals and the second electrical terminals comprise a portion of a first independent electrical circuit, and the third electrical terminals and the fourth electrical terminals comprise a portion of a second independent electrical circuit.

* * * * *